US010568405B2

(12) United States Patent
DeSimone et al.

(10) Patent No.: US 10,568,405 B2
(45) Date of Patent: Feb. 25, 2020

(54) NAIL POLISH PALLET AND NAIL POLISH SYSTEM

(71) Applicants: Julie DeSimone, Garson (CA); Rob Chaput, Garson (CA)

(72) Inventors: Julie DeSimone, Garson (CA); Rob Chaput, Garson (CA)

( * ) Notice: Subject to any disclaimer, the term of this patent is extended or adjusted under 35 U.S.C. 154(b) by 2 days.

(21) Appl. No.: 15/959,339

(22) Filed: Apr. 23, 2018

(65) Prior Publication Data

US 2018/0317629 A1 Nov. 8, 2018

Related U.S. Application Data

(60) Provisional application No. 62/492,439, filed on May 1, 2017.

(51) Int. Cl.

| | |
|---|---|
| ***A45D 34/04*** | (2006.01) |
| ***A46B 15/00*** | (2006.01) |
| ***A46B 9/02*** | (2006.01) |
| ***A45D 29/18*** | (2006.01) |

(52) U.S. Cl.

CPC ..... *A45D 34/045* (2013.01); *A45D 29/18* (2013.01); *A45D 34/043* (2013.01); *A46B 9/021* (2013.01); *A46B 15/0093* (2013.01); *A45D 2200/25* (2013.01); *A46B 2200/01* (2013.01); *A46B 2200/1046* (2013.01)

(58) Field of Classification Search

CPC ..... A45D 34/045; A45D 34/046; A46B 7/04; A46B 7/042; A46B 7/046

USPC ..... 401/118–130

See application file for complete search history.

(56) References Cited

U.S. PATENT DOCUMENTS

2018/0055194 A1* 3/2018 Arredondo ..... A45D 34/046

* cited by examiner

*Primary Examiner* — David J Walczak
*Assistant Examiner* — Joshua R Wiljanen
(74) *Attorney, Agent, or Firm* — Bereskin & Parr LLP/S.E.N.C.R.L., s.r.l.; Isis E. Caulder; Nicholas Aitken

(57) ABSTRACT

A nail polish system includes a nail polish cap and a plurality of nail polish applicator brushes. The nail polish cap has an outer handling surface and an inner applicator brush engagement portion. Each nail polish applicator brush includes a stem, a plurality of bristles, and a cap engagement portion. The stem extends from a stem inboard end to a stem outboard end. The plurality of bristles extend longitudinally from a bristle inboard end, connected to the stem outboard end, to a bristle outboard end. The cap engagement portion is connected to the stem inboard end. The cap engagement end is removably connectable to the inner applicator brush engagement portion of the nail polish cap.

3 Claims, 33 Drawing Sheets

NAIL POLISH PALLET AND NAIL POLISH SYSTEM

FIELD

This application relates to the field of nail polish pallets, and nail polish systems.

INTRODUCTION

Nail polish is a paint, clear or colored, that can be applied to fingernails or toenails to decorate and/or protect the nail plates. Nail painting can require skill and time to perform. Many beauty salons offer services to apply nail polish to customers' nails.

SUMMARY

In one aspect, a nail polish pallet is provided. The nail polish pallet may include a base and at least one nail polish cap stand. The base may have a plurality of nail polish reservoirs inboard of a base periphery. Each reservoir may be formed as a depression in the base with an open reservoir upper end. At least one nail polish cap stand may be coupled to the base. Each nail polish cap stand may include a cap rest and a cap seat. The cap rest may have an upper rest surface with a longitudinal length and transverse width. The upper rest surface may extend longitudinally from a cap rest inner end to a cap rest outer end. The cap rest outer end may be positioned above and outboard of the base and the cap rest inner end. The cap seat may be positioned proximate an inboard portion of the cap rest, and may have a seating surface extending transversely to the upper rest surface.

In another aspect, a nail polish system is provided. The nail polish system may include a nail polish cap, and a plurality nail polish applicator brushes. The nail polish cap may have an outer handling surface and an inner applicator brush engagement portion. Each nail polish applicator brush may include a stem, a plurality of bristles, and a cap engagement portion. The stem may extend longitudinally from a stem inboard end to a stem outboard end. The plurality of bristles may extend longitudinally from a bristle inboard end, connected to the stem outboard end, and a bristle outboard end. The cap engagement portion may be connected to the stem inboard end. The cap engagement end may be removably connectable to the inner applicator brush engagement portion of the nail polish cap.

In another aspect, a method of sanitary practice for a beauty salon is provided. The method may include applying nail polish to at least one nail of a first person, using a first nail polish applicator brush removably connected to a nail polish cap; after said applying, removing the nail polish applicator brush from the nail polish cap, and disposing of the first nail polish applicator brush; connecting a second nail polish applicator brush, structurally identical to the first nail polish applicator brush, to the nail polish cap; and applying nail polish to at least one nail of a second person, using the second nail polish applicator brush removably connected to the nail polish cap.

In another aspect, a nail polish system is provided. The nail polish system may include a brush handle and at least one nail polish applicator brush. The brush handle may have an outer handling surface, a handle longitudinal axis, and a brush engagement portion. Each nail polish applicator brush may include a base extending longitudinally from a base inboard end to a base outboard end, a plurality of bristles extending longitudinally from a bristle inboard end to a bristle outboard end, the bristle inboard end connected to the base outboard end, and a handle engagement portion connected to the base inboard end. The handle engagement portion may be removably and rotatably connectable to the nail polish applicator brush engagement portion, and when connected the nail polish applicator brush may be rotatable relative to the brush handle about a rotation axis transverse to the handle longitudinal axis.

DRAWINGS

DESCRIPTION OF VARIOUS EMBODIMENTS

Figure 1:
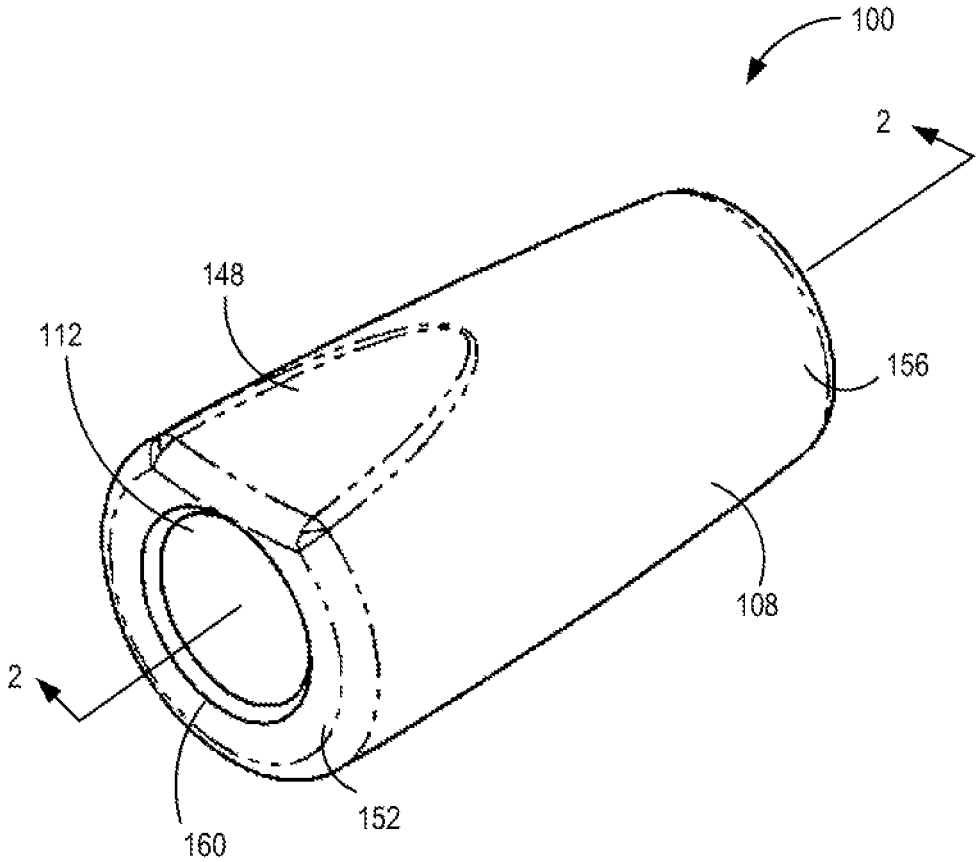
FIG. 1 is a nail polish cap in accordance with an embodiment.
Figure 2:
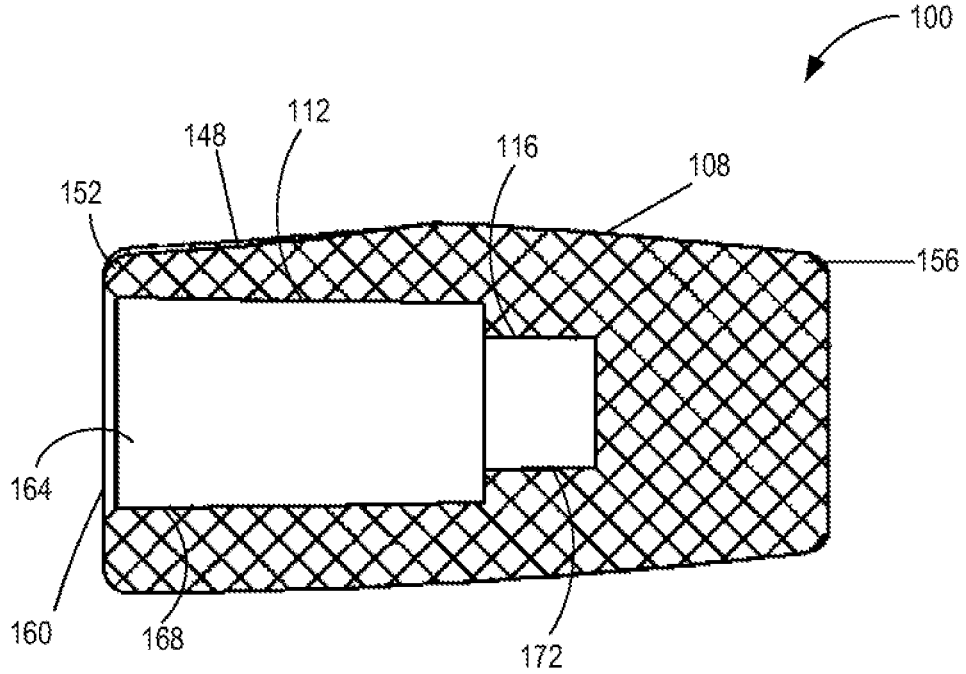
FIG. 2 is a cross-section taken along line 2-2 in FIG. 1.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, a first element is said to be "transverse" to a second element where the elements are oriented within 45 degrees of perpendicular to each other.

As used herein and in the claims, two or more parts are said to be "coupled", "connected", "attached", "joined" or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", or "directly fastened" where the parts are connected in physical contact with each other. As used herein, two or more parts are said to be "rigidly coupled", "rigidly connected", "rigidly attached", "rigidly joined", or "rigidly fastened" where the parts are coupled so as to move as one while maintaining a constant orientation relative to each other. None of the terms "coupled", "connected", "attached", "joined", and "fastened" distinguish the manner in which two or more parts are joined together.

As used herein and in the claims, "nail polish" refers to any fluid coating intended for application to human fingernails or toenails. This includes, but is not limited to, creme finish, chrome and metallic finish, glitter finish, matte finish, flaky finish, holographic finish, duochrome finish, textured finish, neon finish, jelly finish, shimmer finish, foil finish, pearl finish, and suede finish polishes, as well as acrylic, gel, and shellac based polishes.

Standard bottles of nail polish contain enough nail polish to paint many complete sets of fingernails and toenails. Many nail polish bottles include a nail polish cap with a permanently connected nail polish applicator brush which is held inside the nail polish bottle when the nail polish cap seals the nail polish bottle. Fungal infections are common in fingernails and toenails, and fungal spores can be spread by a nail polish applicator brush which has made contact with an infected nail. In the context of a beauty salon, it is important to mitigate the spread of fungal infections between customers. However, it is not commercially feasible to dispose of nail polish bottles after each use in order to avoid reusing the included nail polish applicator brush. Also, sanitizing the included nail polish applicator brush may be inconvenient and time consuming.

FIGS. 1-4 show a nail polish cap 100 and nail polish applicator brush 104, in accordance with an embodiment. Nail polish applicator brush 104 is removably connectable to nail polish cap 100. This allows nail polish applicator brush 104 to be disposed after each use, and the nail polish cap 100 to be replaced onto the bottle of nail polish. In turn, this allow the bottle of nail polish to be used in several sessions without risk of spreading fungal spores, and without the time and inconvenience of sanitizing the used nail polish applicator brush 104. Before reclosing the bottle of nail polish with nail polish cap 100, or after reopening the nail polish bottle for a subsequent use, a new (unused), clean (e.g. sterile or free of fungal spores) nail polish applicator brush 104 can be connected to the nail polish cap 100. In the context of a beauty salon, nail polish cap 100 and disposable nail polish applicator brushes 104 can enhance time efficiency by eliminating brush sanitizing activities, and improve customer satisfaction with a visibly effective sanitation practice (disposal of used nail polish applicator brushes).

As shown, nail polish cap 100 includes an outer handling surface 108, an inner bottle engagement portion 112, and an inner applicator brush engagement portion 116. The outer handling surface 108 provides a surface to grasp by a user's hands when manipulating nail polish cap 100 to apply nail polish from the nail polish applicator brush 104 to nails. The inner bottle engagement portion 112 is structured to releasably engage with a nail polish bottle. When so engaged, the nail polish cap 100 may seal the nail polish bottle. The inner applicator brush engagement portion is structured to releasably engage with a nail polish applicator brush 104. When so engaged, the nail polish cap 100 provides a handle for manipulating the connected nail polish applicator brush 104 for applying nail polish to nails.

In alternative embodiments, nail polish cap 100 does not include an inner bottle engagement portion 112 that releasably engages a nail polish bottle to allow the nail polish cap 100 to seal an opening of a nail polish bottle. Instead, the nail polish cap 100 may be sized to sit atop the nail polish bottle (also referred to as 'capping' the nail polish bottle) without attaching to or sealing the nail polish bottle.

Nail polish applicator brush 104 is shown including a stem 120, a plurality of bristles 124, and a cap engagement portion 128. Stem 120 extends longitudinally from a stem inboard end 132 to a stem outboard end 136. Bristles 124 are connected to stem 120, and extend longitudinally from a bristles inboard end 140 to a bristles outboard end 144. Bristles inboard end 140 is connected to stem outboard end 136, and bristles outboard end 144 is free to receive nail polish and paint the nail polish onto nails. Cap engagement portion 128 is connected to stem inboard end 140, and is removably connectable to inner applicator brush engagement portion 116 of nail polish cap 100.

Figure 21:
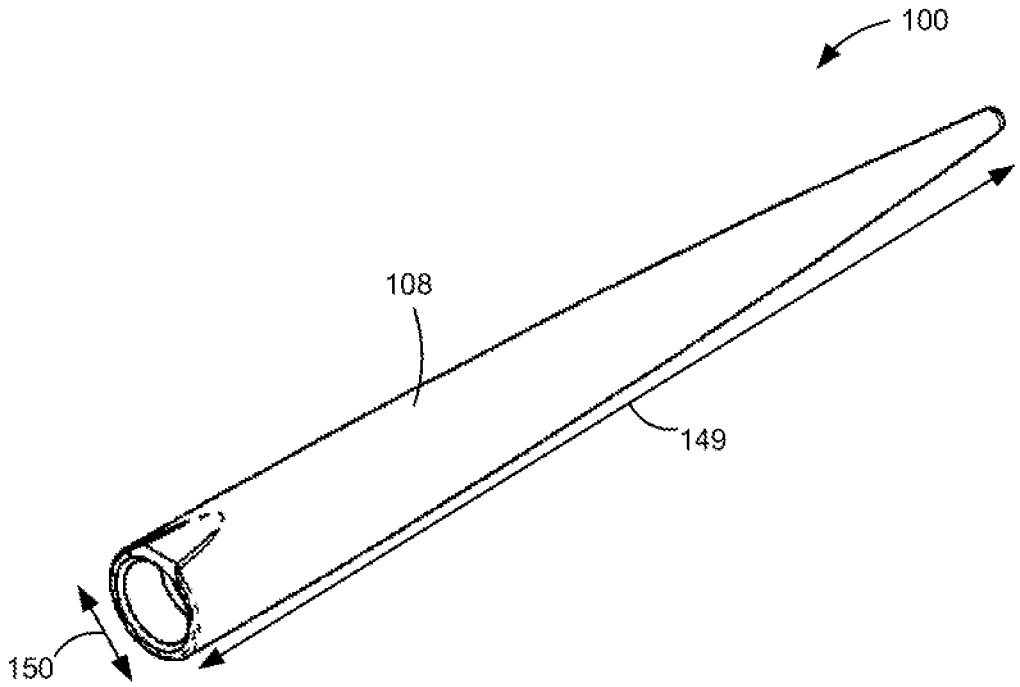
FIG. 21 is a perspective view of a nail polish cap in accordance with another embodiment.
Figure 22:
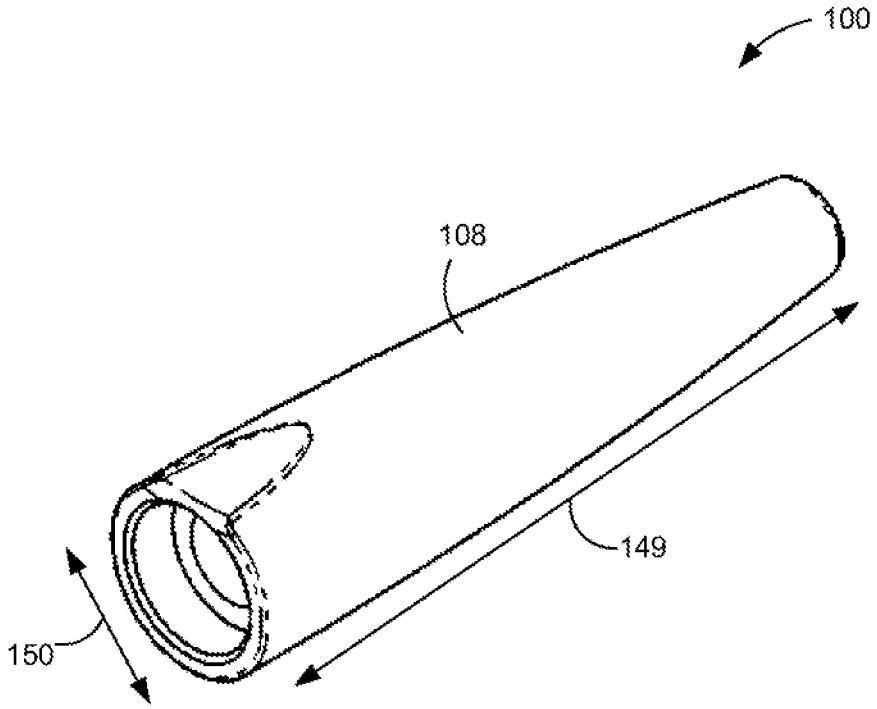
FIG. 22 is a perspective view of a nail polish cap in accordance with another embodiment.

Still referring to FIGS. 1-4, nail polish cap 100 can include any outer handling surface 108 suitable for manual grasping (i.e. by hand) to manipulate nail polish cap 100 and a connected nail polish applicator brush 104 to paint nail polish onto nails. In the illustrated example, outer handling surface 108 is predominantly cylindrical in shape with a flat face 148 for added grip. FIGS. 21-22 show alternative embodiments including outer handling surfaces 108 with elongated proportions. As shown, outer handling surface 108 may have a length 149 to width (or diameter) 150 ratio of 5:1 or greater. This may improve manual handling of nail polish cap 100 for better user control when painting. In some embodiments, outer handling surface 108 may have a different shape, which may include a triangular, rectangular, hexagonal or other regular or irregular cross-sectional shape.

Returning to FIGS. 1-4, nail polish cap 100 can include any inner bottle engagement portion 112 suitable for removable connection with a nail polish bottle. Nail polish cap 100 extends longitudinally from a cap lower end 152 to a cap upper end 156. As shown, cap lower end 152 includes an opening 160 to a cavity 164 (also referred to as a recess). Inner bottle engagement portion 112 may define or be provided on the inward facing wall(s) 168 of cap cavity 164. In use, the neck finish of a nail polish bottle may be inserted into cavity 164 and engaged by inner bottle engagement portion 112, which may act to retain nail polish cap 100 on the nail polish bottle until selectively removed by the user. Inner bottle engagement portion 112 may include flat walls as shown, that form a press fit onto the nail polish bottle, or may include engagement members such as threads, protrusions, or recesses.

Still referring to FIGS. 1-4, inner brush engagement portion 116 and cap engagement portion 128 can have any configurations suitable to provide a connection that is secure while painting, and manually releasable (i.e. by hand, without tools). As shown, inner brush engagement portion 112 may define or be provided on cap cavity wall(s) 172 located upwardly (i.e. inwardly) of inner bottle engagement portion 112. Inner brush engagement portion 116 may be sized to form a press fit with inner bottle engagement portion 112 when received in cap cavity 164. As shown, inner brush engagement portion 116 may be moved longitudinally through cap opening 160 past cap engagement portion 128 into engagement with inner applicator brush engagement portion 116.

Brush stem 120 may be spaced apart from inner bottle engagement portion 112 when nail polish applicator brush 104 is connected to nail polish cap 100. As shown, when nail polish applicator brush 104 is connected to nail polish cap 100, brush stem 120 may be spaced apart from inner bottle engagement portion 112 by a radial distance 176. Radial distance 176 may provide clearance for the neck finish of a nail polish bottle inserted into engagement with inner bottle engagement portion 112. Consequently, radial distance 176 may permit nail polish cap 100 to be connected to a nail polish bottle while nail polish applicator brush 104 is connected to nail polish cap 100. In this case, nail polish applicator brush 104 may be a new, clean applicator brush connected after disposing the previous, used applicator brush.

In some embodiments, a guide collar 180 may be connected to stem inboard end 132. The guide collar 180 may help guide cap engagement portion 128 into engagement with brush engagement portion 116 when connecting nail polish applicator brush 104 to nail polish cap 100. As shown, guide collar 180 may be positioned below cap engagement portion 128, and extend radially outwardly of cap engagement portion 128. In use, guide collar 180 may interact with the cavity wall(s) 168 to help center cap engagement portion 128 as it moves into engagement with brush engagement portion 116. This can make connecting nail polish applicator brush 104 to nail polish cap 100 easier.

Figure 4:
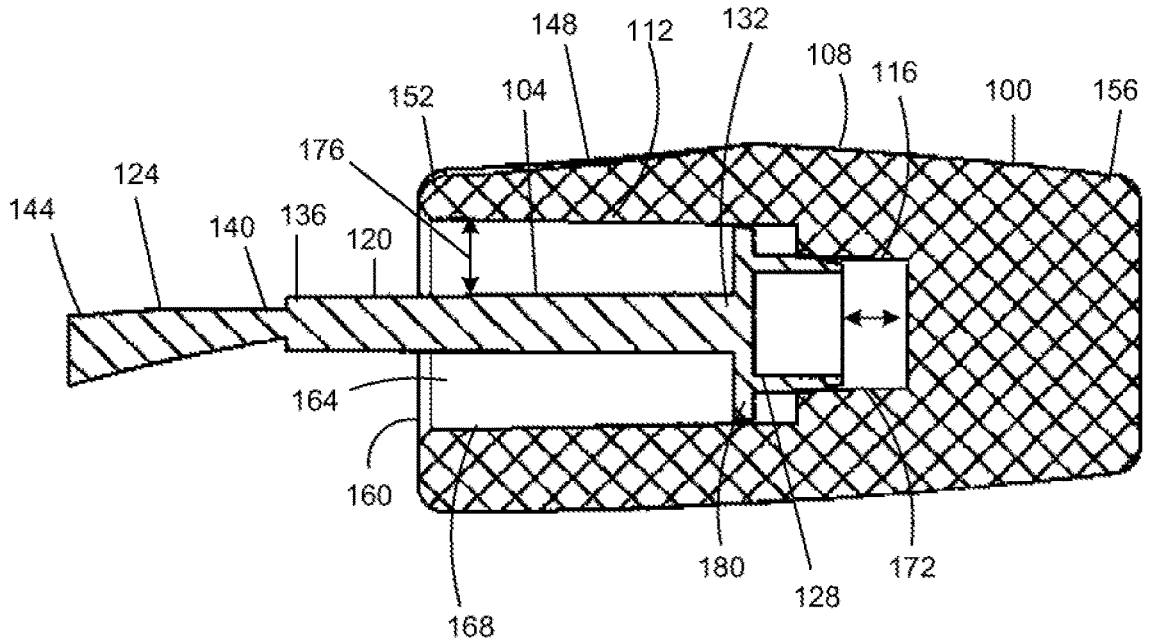
FIG. 4 is a cross-section taken along line 4-4 in FIG. 2.
Figure 5:
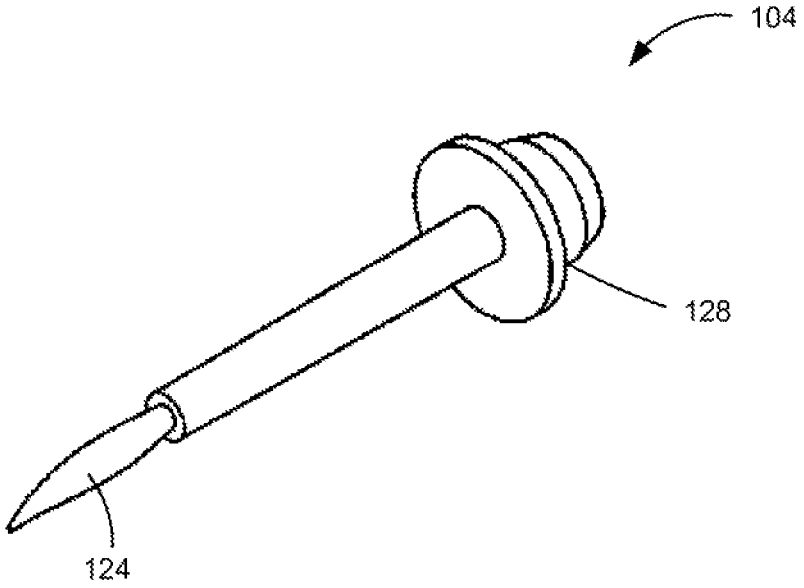
FIG. 5 is a perspective view of a nail polish applicator brush in accordance with an embodiment.
Figure 6:
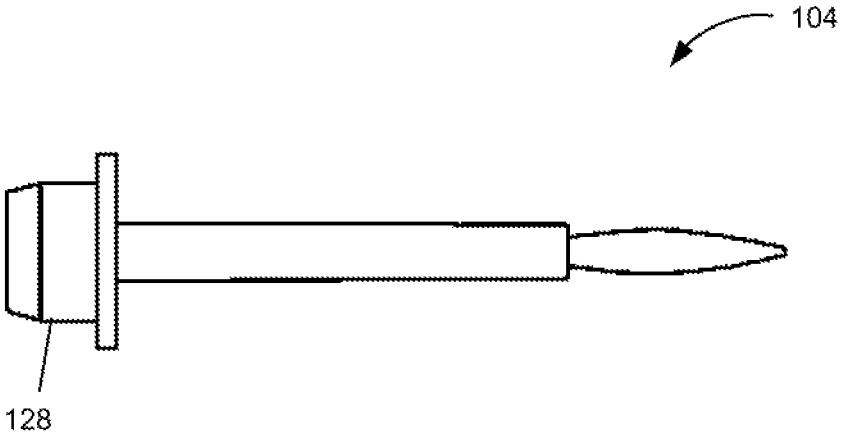
FIG. 6 is a side elevation view of the nail polish applicator brush of FIG. 5.
Figure 7:
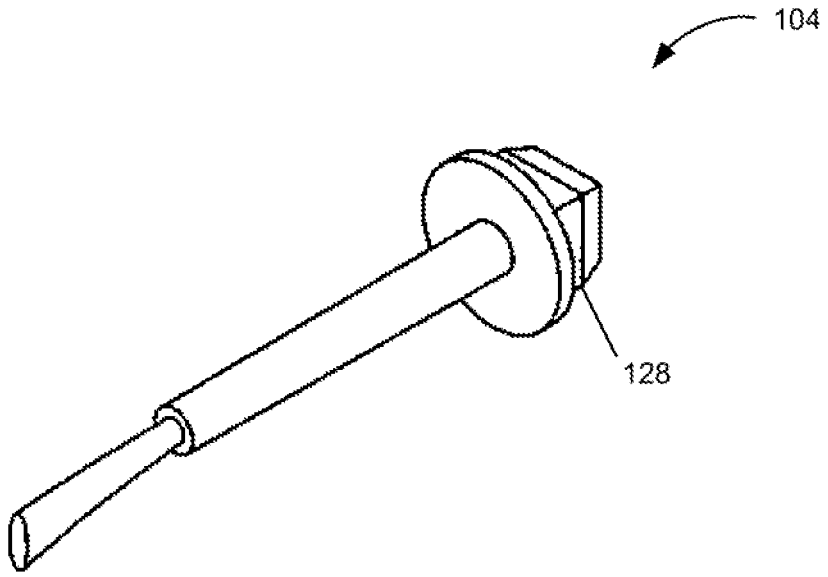
FIG. 7 is a perspective view of a nail polish applicator brush in accordance with another embodiment.
Figure 8:
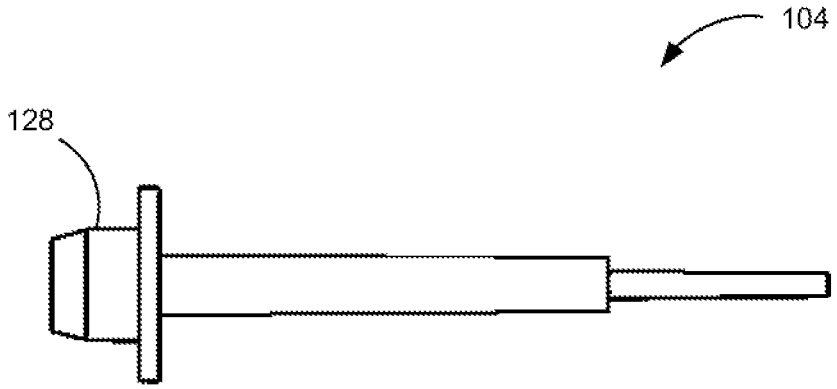
FIG. 8 is a side elevation view of the nail polish applicator brush of FIG. 7.
Figure 9:
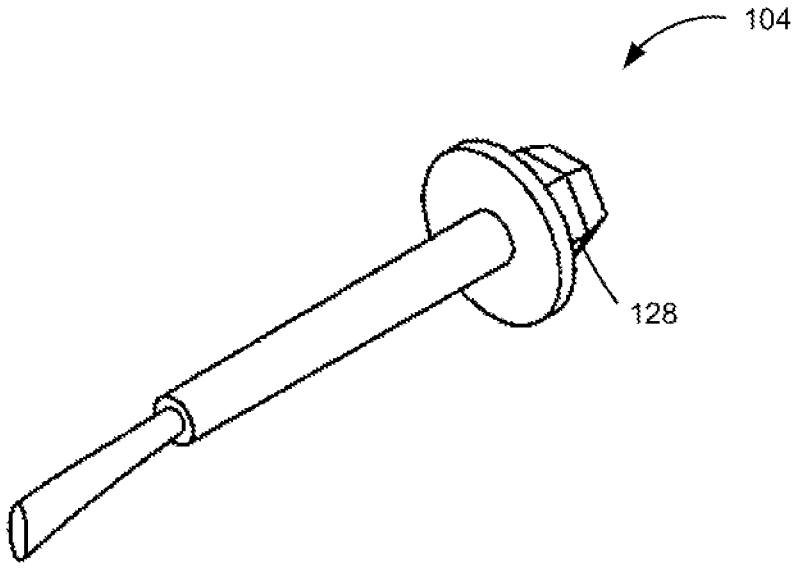
FIG. 9 is a perspective view of a nail polish applicator brush in accordance with another embodiment.
Figure 10:
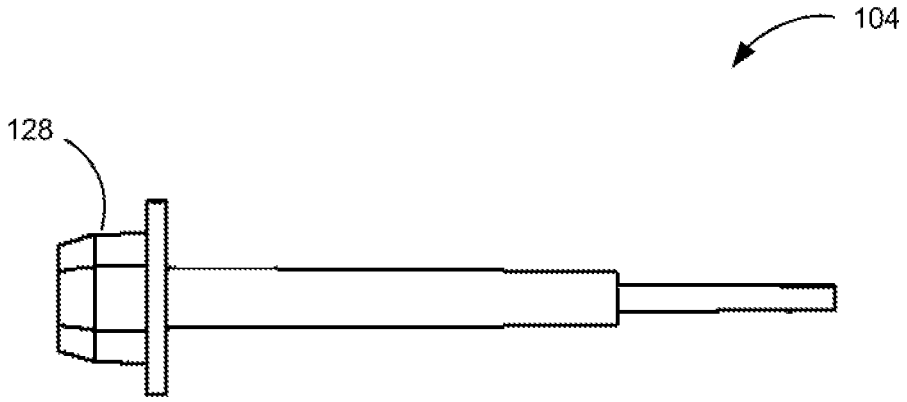
FIG. 10 is a side elevation view of the nail polish applicator brush of FIG. 9.

Brush engagement portion 116 and cap engagement portion 128 can have any mating configurations. FIGS. 5-6 illustrates an embodiment including a cap engagement portion 128 having a round (e.g. circular) cross-sectional shape for forming a press fit with brush engagement portion 116 (FIG. 4). FIGS. 7-8 illustrate an embodiment including a cap engagement portion 128 having a rectangular (e.g. square) cross-sectional shape for forming a press fit with stem engagement portion 116 (FIG. 4). FIGS. 9-10 illustrate an embodiment including a cap engagement portion 128 having an eight-sided (e.g. octagonal) cross-sectional shape for forming a press fit with stem engagement portion 116 (FIG. 4).

Figure 11:
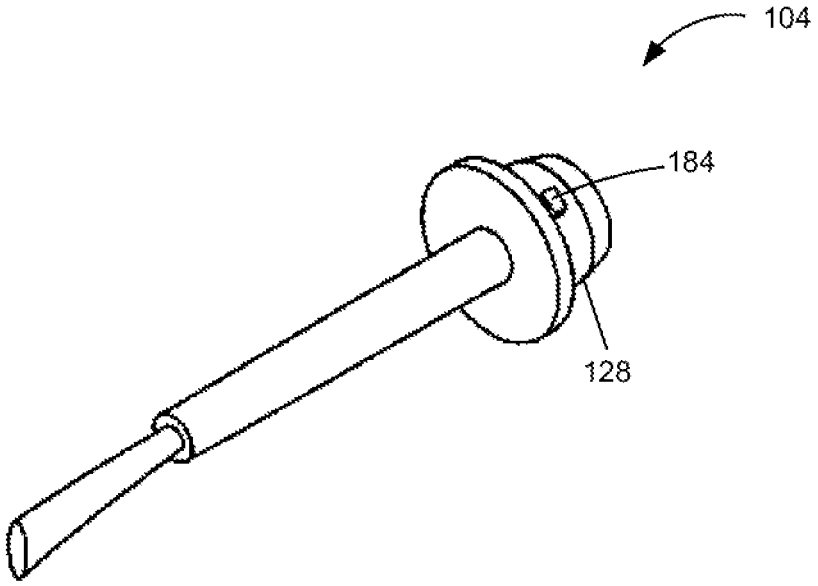
FIG. 11 is a perspective view of a nail polish applicator brush in accordance with another embodiment.
Figure 12:
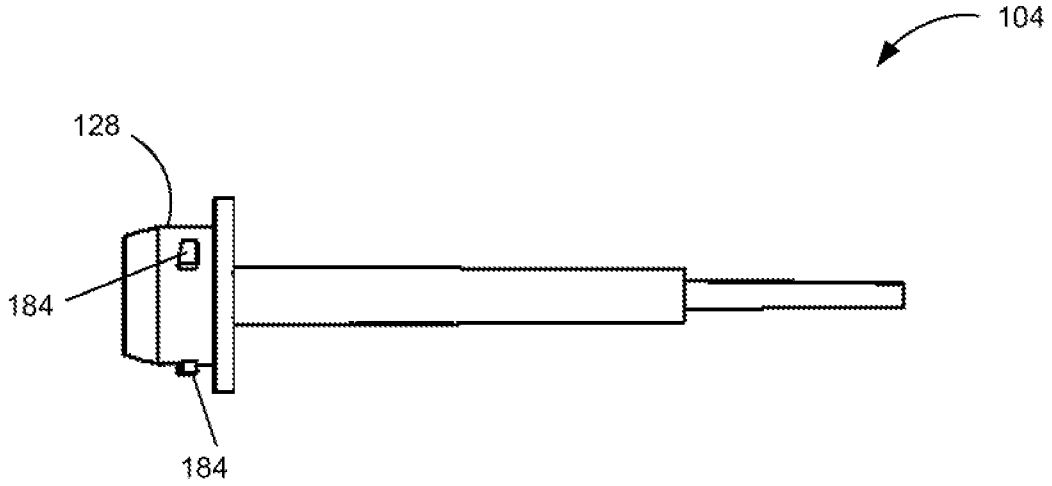
FIG. 12 is a side elevation view of the nail polish applicator brush of FIG. 11.

Referring to FIGS. 11-12, in some embodiments, cap engagement portion 128 may include one or more protruding engagement members 184. In the illustrated embodiment, cap engagement portion 128 includes a plurality of engagement members 184 which are formed as discrete, peripherally distributed, protrusions. Engagement members 184 may mate with features of brush engagement portion 116 (FIG. 4) to form a secure, removable connection.

Figure 13:
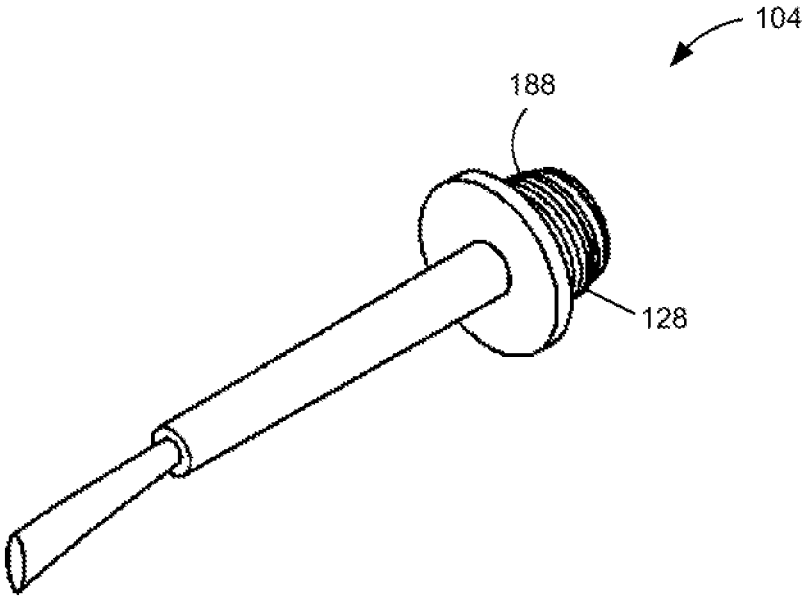
FIG. 13 is a perspective view of a nail polish applicator brush in accordance with another embodiment.
Figure 14:
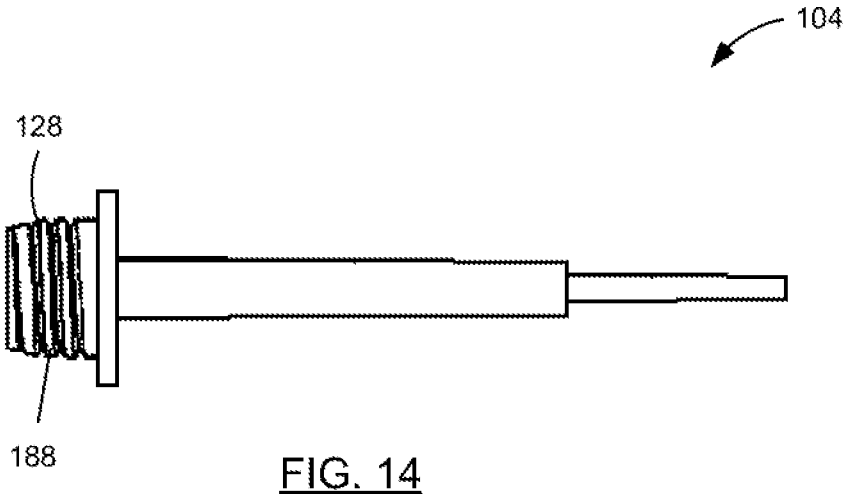
FIG. 14 is a side elevation view of the nail polish applicator brush of FIG. 13.

Referring to FIGS. 13-14, in some embodiments, cap engagement portion 128 may include threads 188. Threads 188 may be sized to mate with corresponding threads of cap engagement portion 128, and thereby form a secure, removable connection.

Returning to FIG. 4, cap engagement portion 128 may be connected to brush stem 120 in any manner that provides a secure connection. For example, cap engagement portion 128 may be integrally formed with brush stem 120 as shown, or discretely formed and attached to brush stem 120 (e.g. by adhesive, welds, or a fastener).

Figure 3:
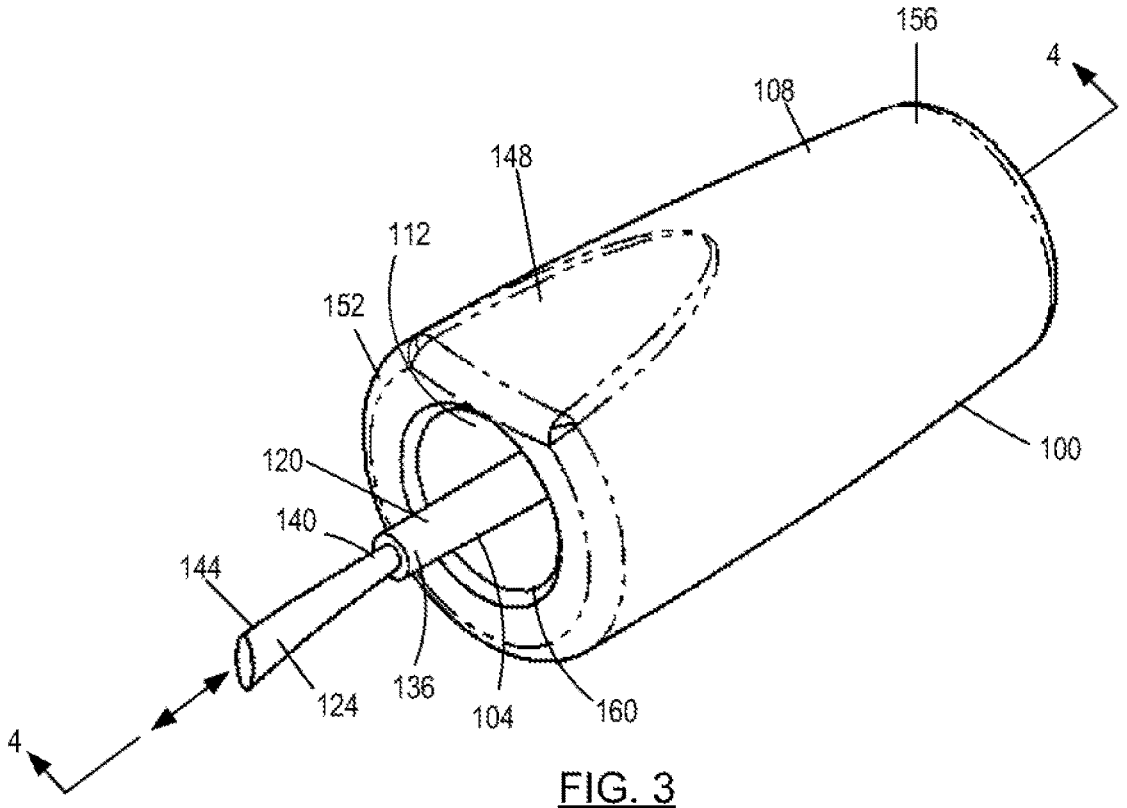
FIG. 3 is a perspective view a nail polish applicator brush being connected to the nail polish cap of FIG. 1.
Figure 15:
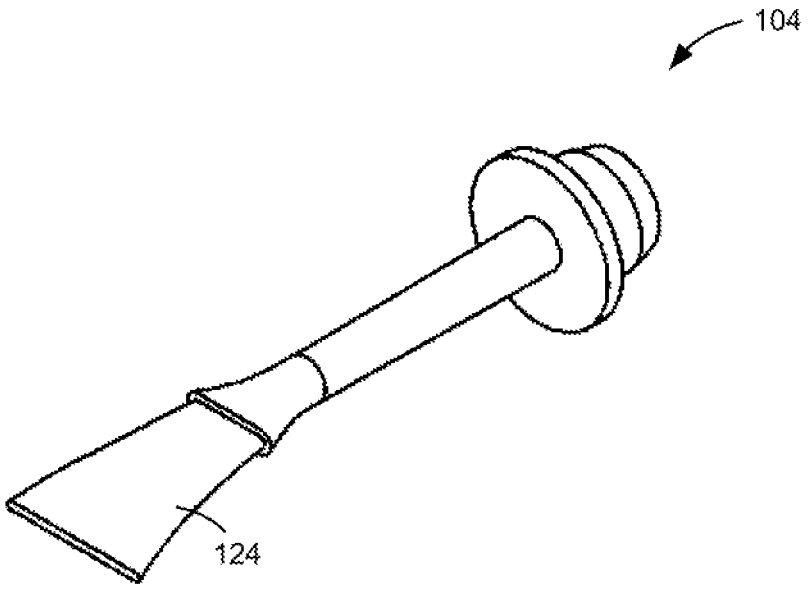
FIG. 15 is a perspective view of a nail polish applicator brush in accordance with another embodiment.
Figure 16:
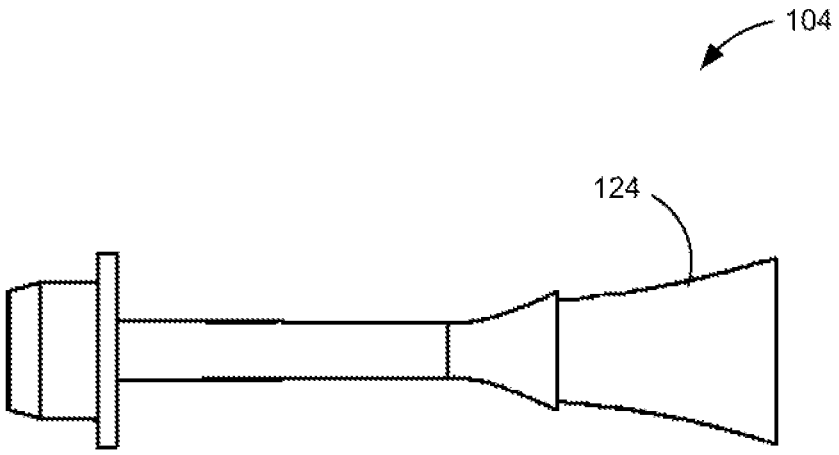
FIG. 16 is a side elevation view of the nail polish applicator brush of FIG. 15.
Figure 17:
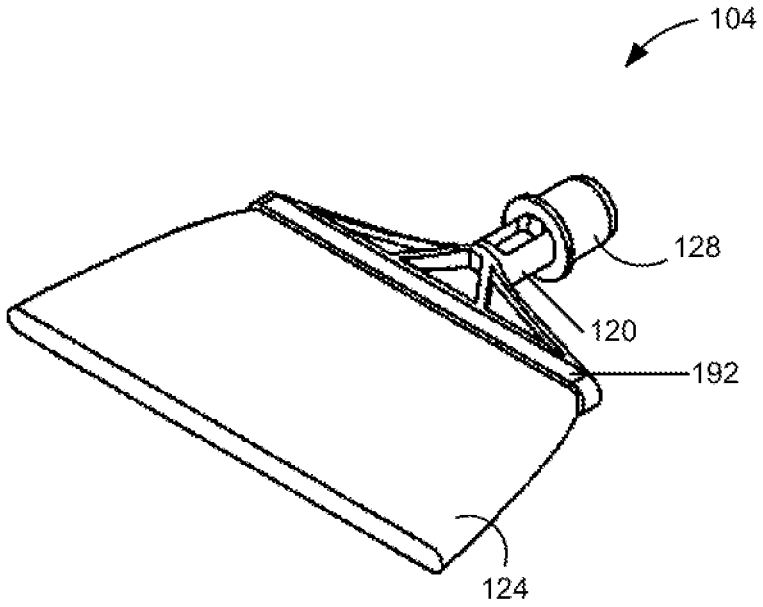
FIG. 17 is a perspective view of a nail polish applicator brush in accordance with another embodiment.
Figure 18:
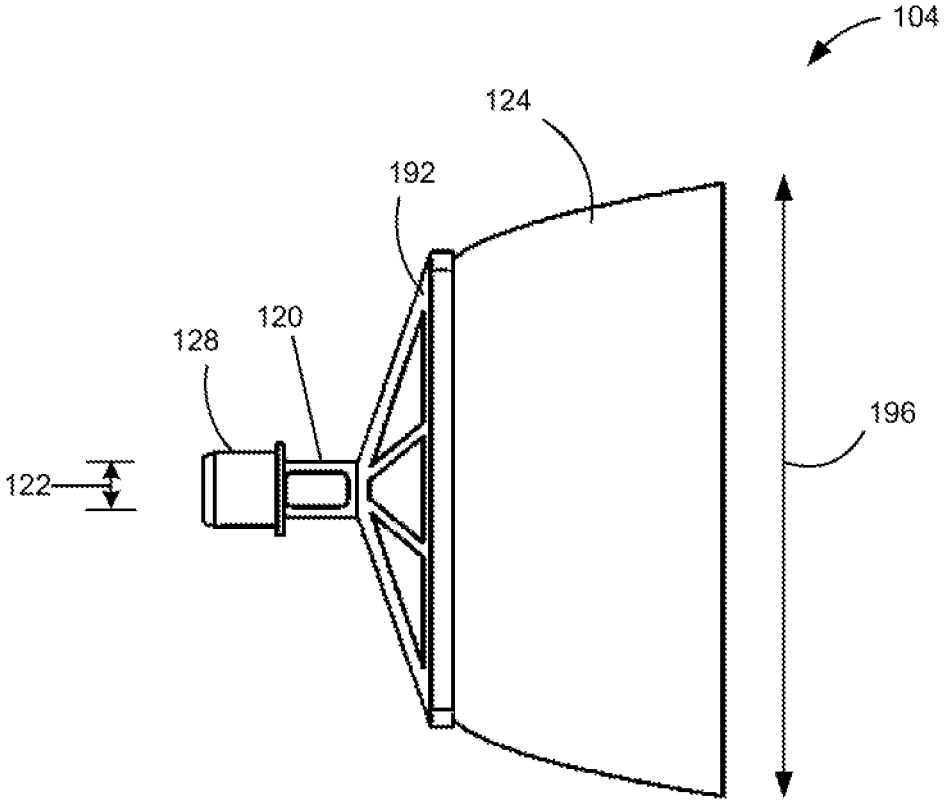
FIG. 18 is a side elevation view of the nail polish applicator brush of FIG. 17.
Figure 19:
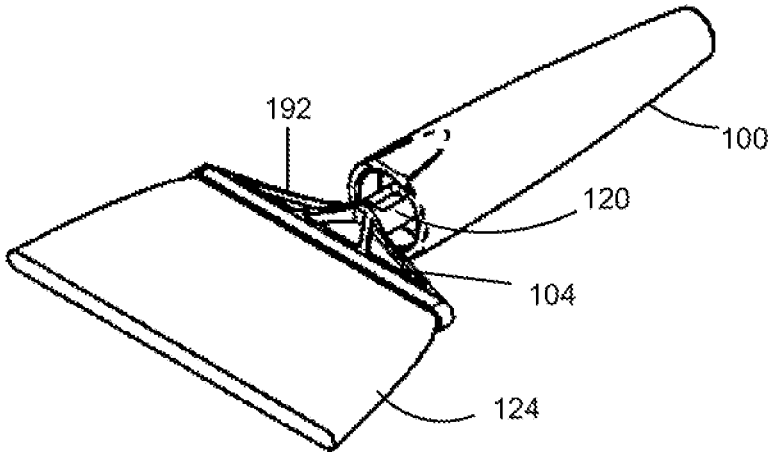
FIG. 19 is a perspective view of a nail polish cap and connected nail polish applicator brush, in accordance with an embodiment.
Figure 20:
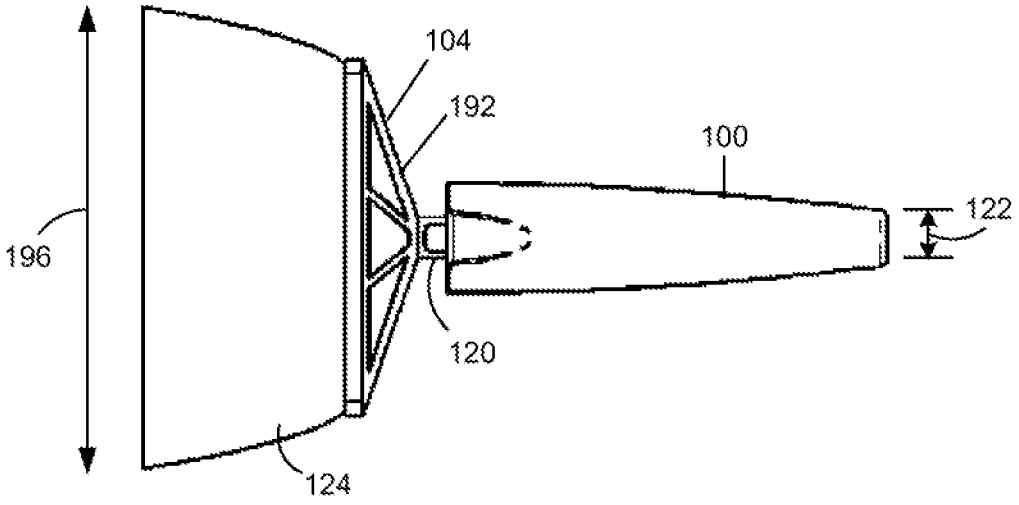
FIG. 20 is a top plan view of the nail polish cap and connected nail polish applicator brush of FIG. 19.

Referring to FIG. 3, nail polish applicator brush 104 can have any brush bristles 124 suitable for applying nail polish to nails. For example, brush bristles 124 may have a round shape as shown in FIG. 3, a pointed round shape as shown in FIG. 5, or a flat shape as shown in FIGS. 15-16. FIGS. 17-20 show another embodiment of nail polish applicator brush 104 including bristles 124 having an extra-wide flat shape. As shown, bristles 124 may be connected to brush stem 120 by a bristle connector 192. This can allow bristles 124 to have a bundle width 196 that is wider than brush stem width 122. As seen in FIGS. 19-20, this can allow brush stem width 122 to maintain a diameter narrow enough to insert into engagement with nail polish cap 100.

Figure 23:
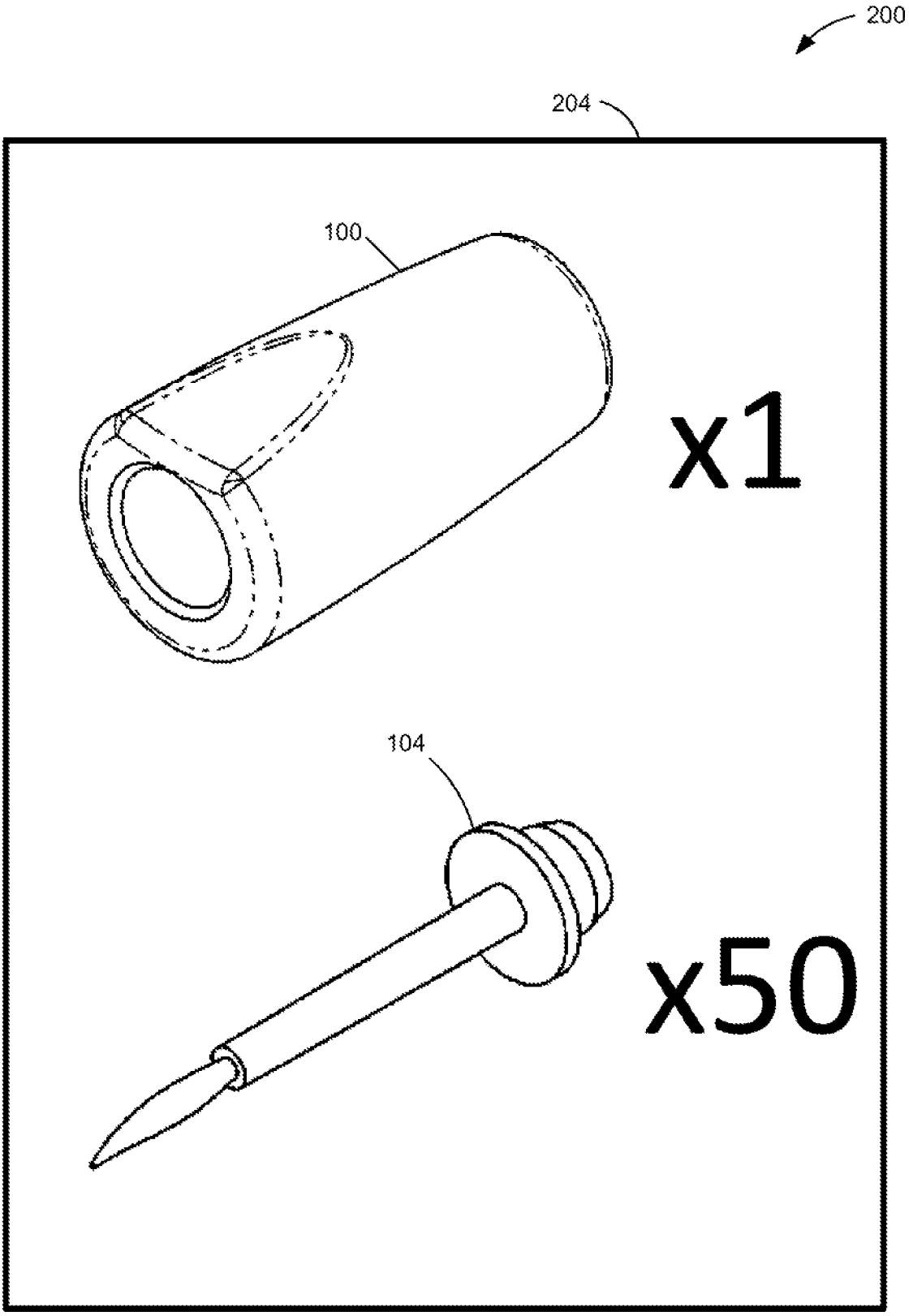
FIG. 23 is a schematic view of a nail polish system in accordance with an embodiment.

FIG. 23 is a schematic view of a nail polish system 200. Nail polish system 200 may include at least one nail polish cap 100, and a plurality of nail polish applicator brushes 104 that are greater in number than the nail polish cap(s) 100. For example, nail polish system 200 may include less than 10 nail polish caps 100 and at least 50 nail polish applicator brushes 104. The ratio of nail polish applicator brushes 104 to nail polish caps 100 may be at least 5 to 1 so that a cap can be reused with enough nail polish applicator brushes 104 to consume a bottle of nail polish. In some embodiments, the ratio of nail polish applicator brushes 104 to nail polish caps 100 may be at least 50 to 1 so that a cap can be reused with enough nail polish applicator brushes 104 to consume several bottles of nail polish.

Within nail polish system 200, the plurality of nail polish applicator brushes 104 may include many structurally identical (also referred to as physically identical) nail polish applicator brushes 104. This allows the nail polish applicator brushes 104 to be disposed and replaced by an identical, unused nail polish applicator brush 104.

In some embodiments, nail polish system 200 may include two or more different types of nail polish applicator brushes 104. For example, each type of the nail polish applicator brush 104 may differ by size and/or shape of bristles 124. In this case, nail polish system 200 would include a plurality identical nail polish applicator brushes 104 of each type, so that used nail polish applicator brushes 104 can be disposed of and replaced.

As shown, nail polish system 200 may be packaged in sales packaging 204 for sale and distribution to purchasers (e.g. beauty salons or retail consumers).

Figure 48:
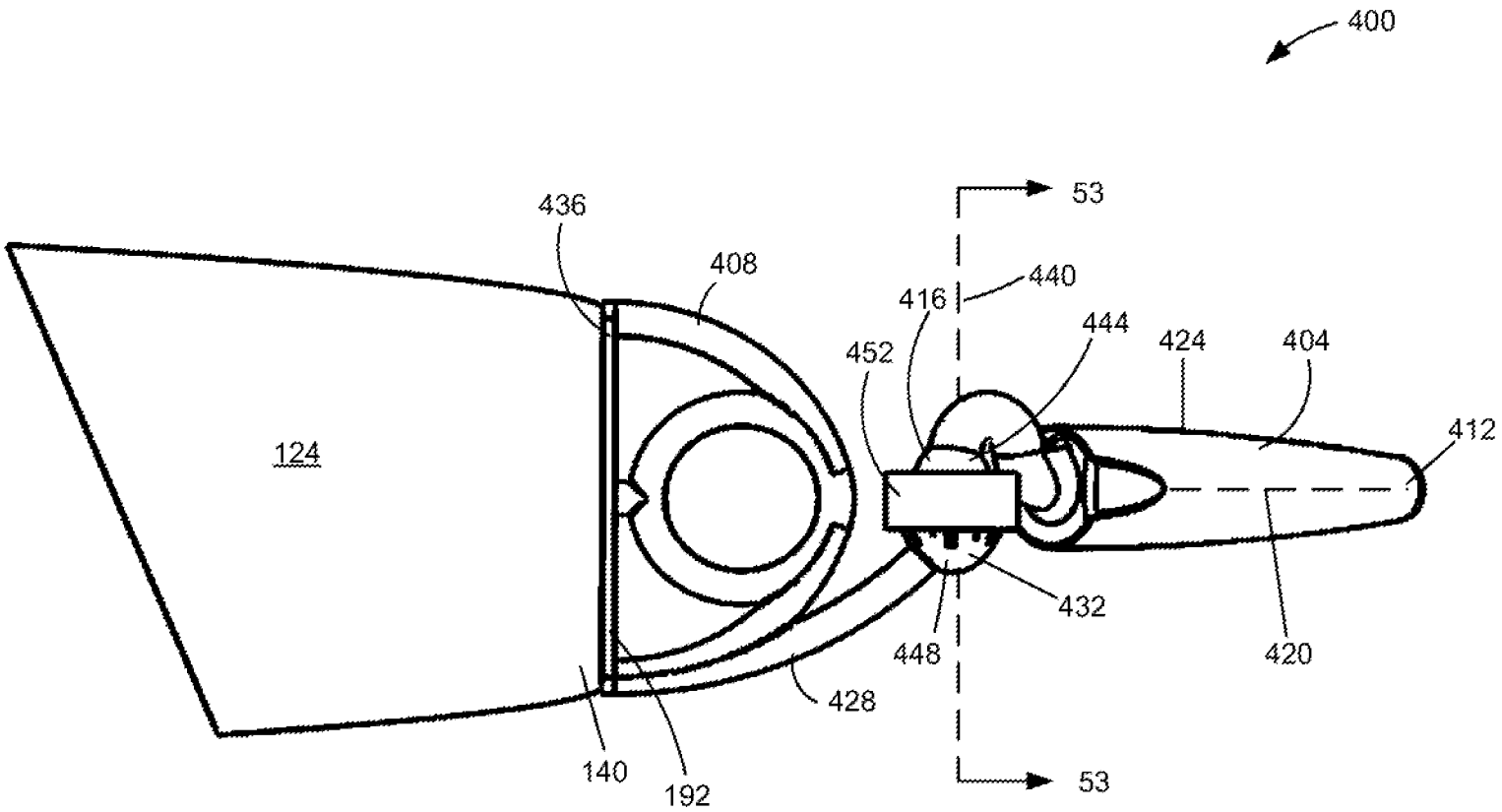
FIG. 48 is a top view of a nail polish system in accordance with another embodiment.
Figure 49:
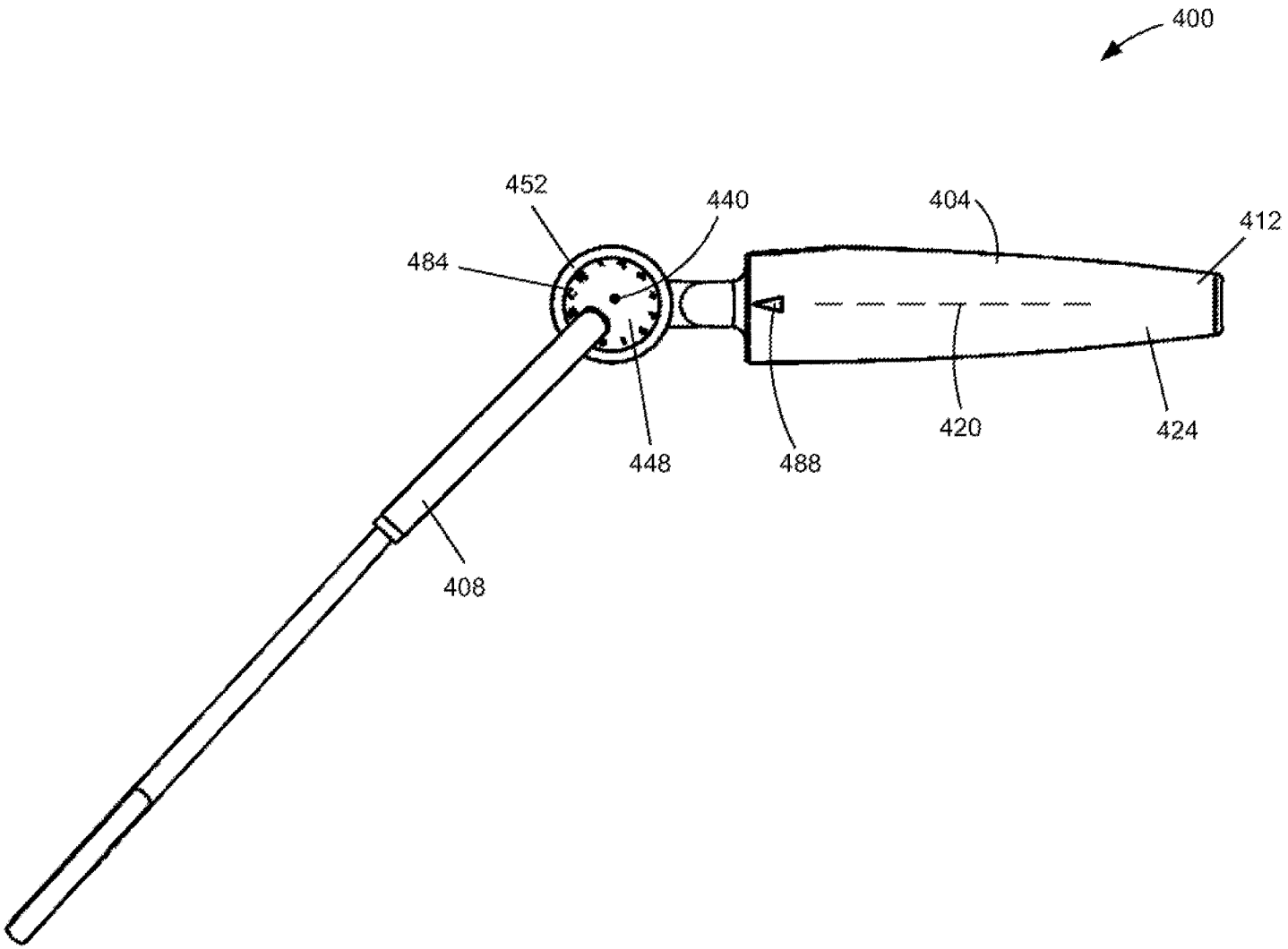
FIG. 49 is a side elevation view of the nail polish system of FIG. 48.

Reference is now made to FIGS. 48-49, which show a nail polish system 400 in accordance with another embodiment. As shown, nail polish system 400 includes a brush handle 404 connected to a nail polish applicator brush 408. As in other embodiments described herein, applicator brush 408 may be removably connected to brush handle 404. For example, applicator brush 408 may be disposable, and brush handle 404 may be reusable with a new applicator brush 408 as each applicator brush 408 is disposed. In other embodiments, applicator brush 408 is not disposable. For example, brush handle 404 may be permanently connected to applicator brush 408.

Figure 50:
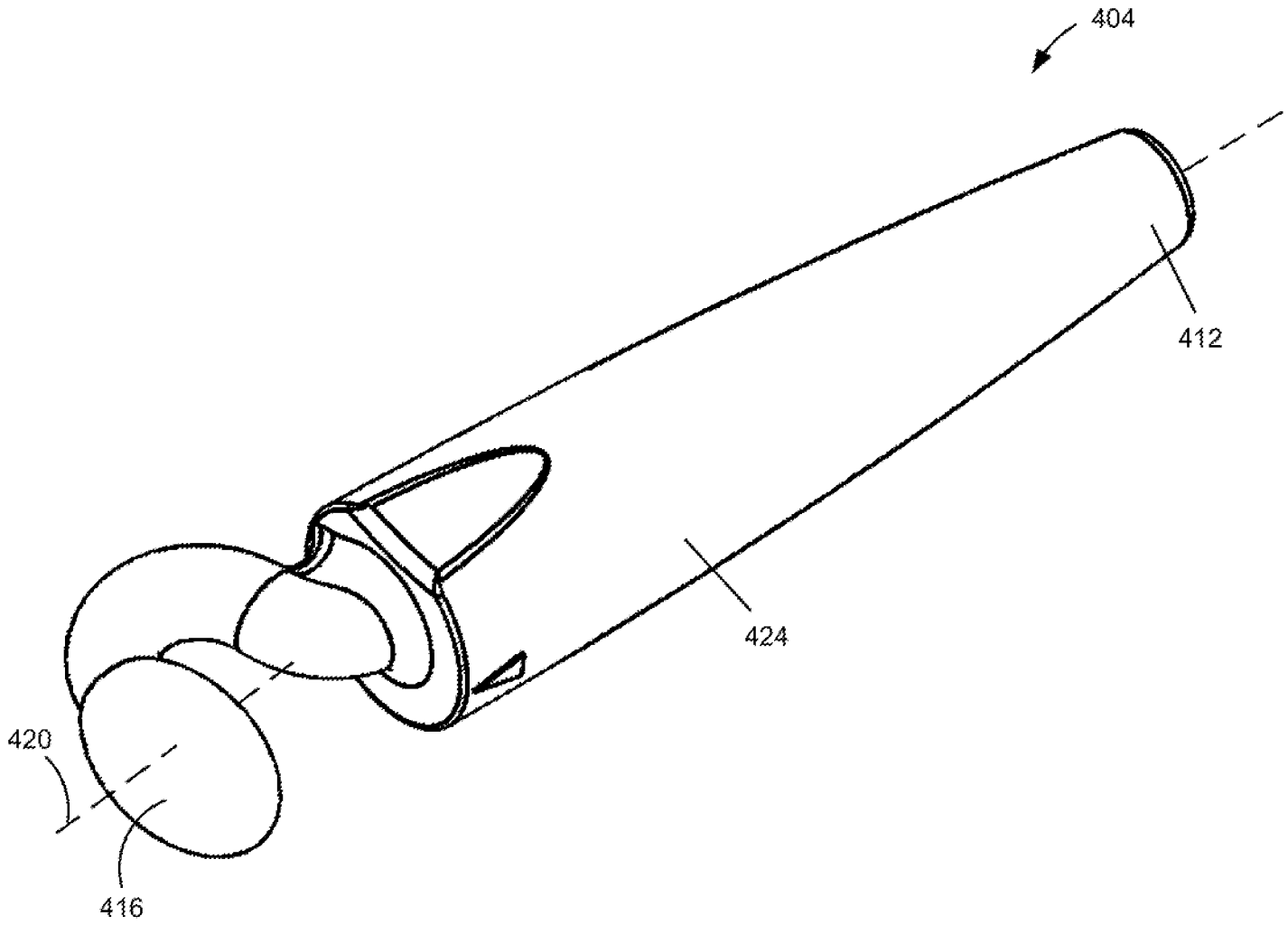
FIG. 50 is a perspective view of a brush handle of the nail polish system of FIG. 48.

Referring to FIGS. 48 and 50, brush handle 404 extends from an inboard end 412 to an outboard end 416, and has a longitudinal axis 420. As shown, brush handle 404 has an outer handling surface 424 sized to be manually held (i.e. by hand) and manipulated to apply nail polish using applicator brush 408.

Figure 51:
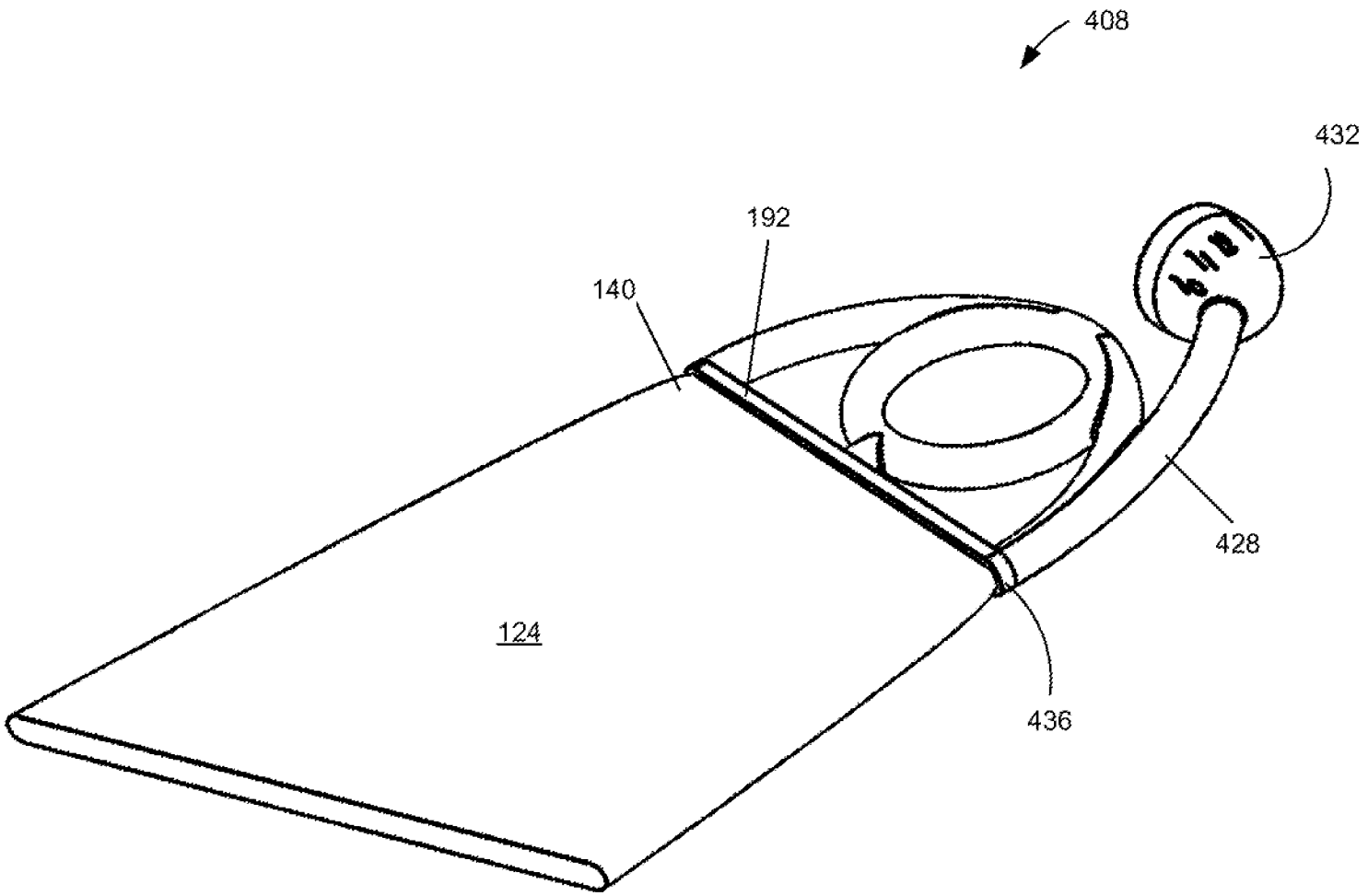
FIG. 51 is a front perspective view of an applicator brush of the nail polish system of FIG. 48.
Figure 52:
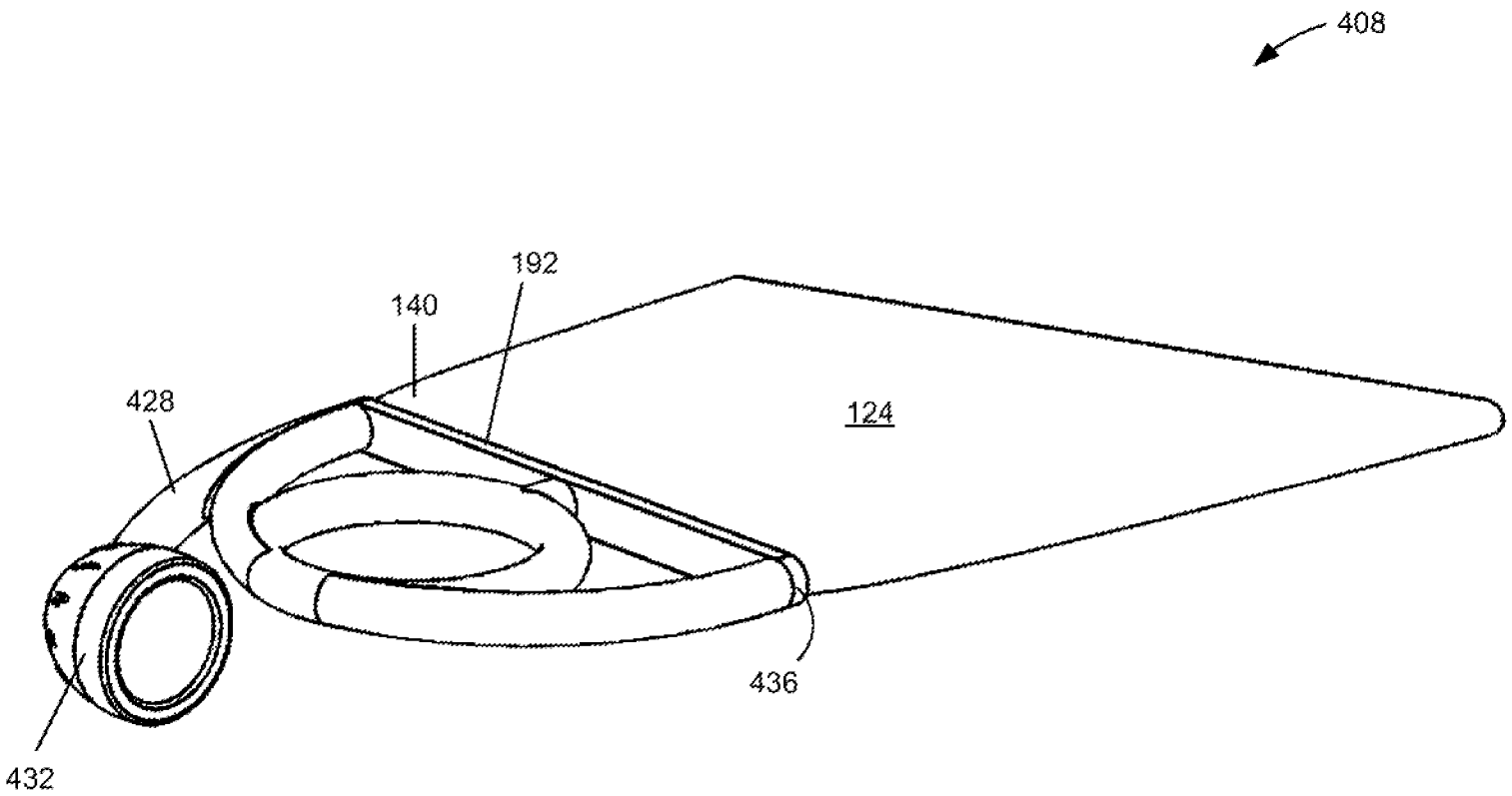
FIG. 52 is a rear perspective view of the applicator brush of FIG. 51.

Referring to FIGS. 48 and 51-52, applicator brush 408 may include a base 428 that extends longitudinally from a base inboard end 432 to a base outboard end 436. Bristles 124 have an inboard end 140 connected to base outboard end 436, and extend longitudinally outward of brush base 428. Applicator brush 408 may have any arrangement of bristles 124. For example, applicator brush 408 may have a round, flat, bright, filbert, fan, angle, mop, or rigger configuration as they are known in the art. In the illustrated example, brush base 428 includes a brush connector 192 (e.g. ferrule) that provides a configuration of bristles 124 known as an angle configuration.

Returning to FIGS. 48-49, brush handle 404 may be rotatably connected to applicator brush 408, whereby applicator brush 408 can rotate about a rotation axis 440. As shown, rotation axis 440 is transverse to handle longitudinal axis 420. For example, rotation axis 440 may be perpendicular to handle longitudinal axis 420 as illustrated. The rotatable connection allows the user to orient applicator brush 408 at an angle that provides best comfort and control. In turn, this allows users (e.g. nail salon staff) to comfortably service clients for extended periods and produce high quality work.

Brush handle 404 may be connected to applicator brush 408 in any manner that allows applicator brush 408 to rotate about rotation axis 440 while connected to brush handle 404. In the illustrated example, brush handle 404 includes a brush engagement portion 444 at handle outboard end 416, applicator brush 408 includes a handle engagement portion 448 at brush base inboard end 432, and engagement portions 444 and 448 are rotatably joined by a rotary lock 452. Rotary lock 452 may be movable between an unlocked position and a locked position. In the unlocked position, applicator brush 408 may be rotatable about rotation axis 440 relative to brush handle 404. In the locked position, rotation of applicator brush 408 relative to brush handle 404 may be inhibited, whereby the relative angle between applicator brush 408 and brush handle 404 is fixed. Rotary lock 452 allows a user to adjust the angular position of applicator brush 408 when in the unlocked position, and then maintain that angular orientation when in the locked position. Thus, rotary lock 452 may provide the flexibility for the user to choose an angular orientation when unlocked, and the consistency of a fixed angular orientation when locked.

Figure 53:
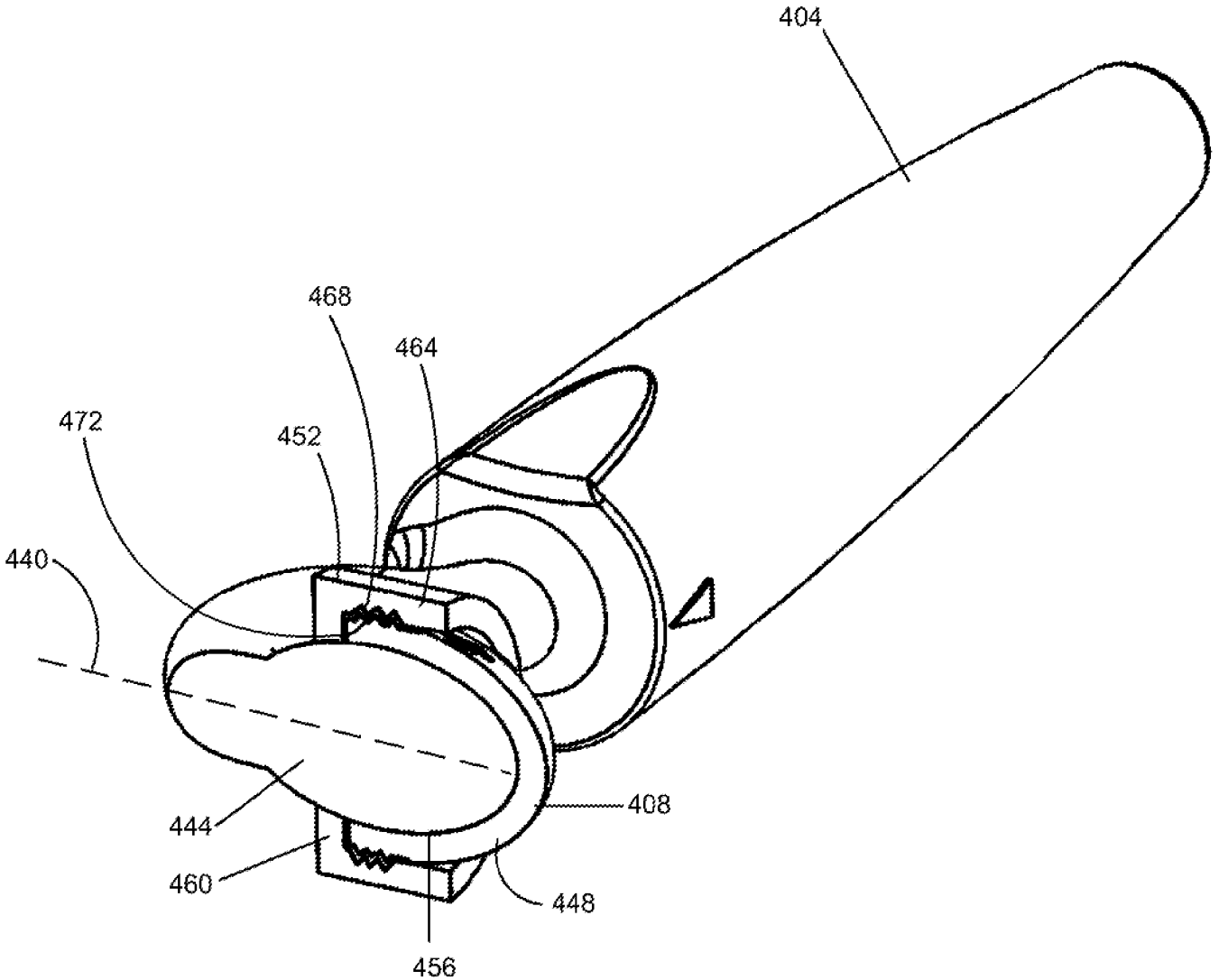
FIG. 53 is a cross-sectional view taken alone line 53-53 in FIG. 48
Figure 55:
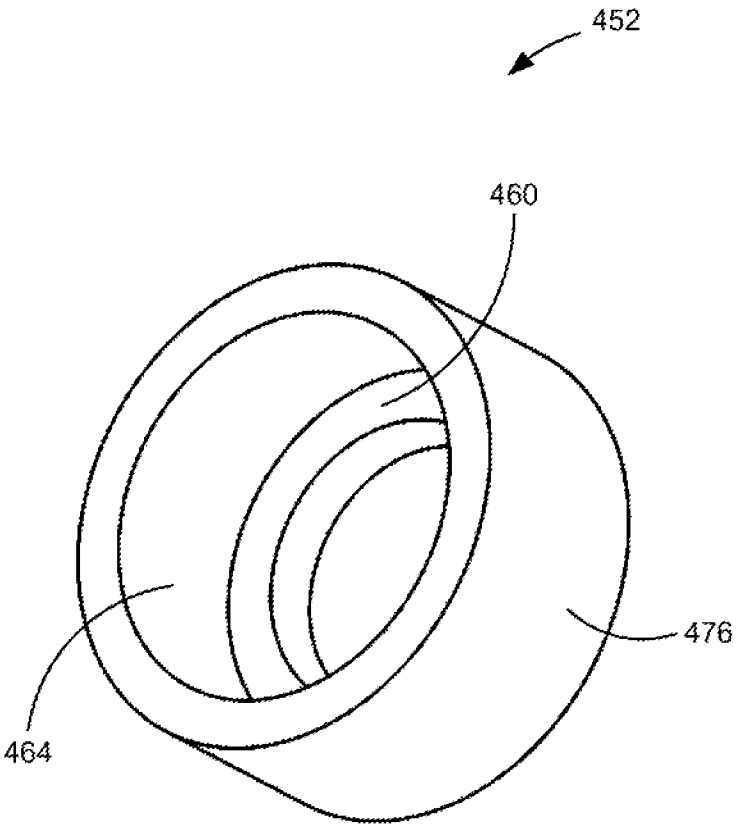
FIG. 55 is a rear perspective view of the rotary lock of FIG. 54.
Figure 54:
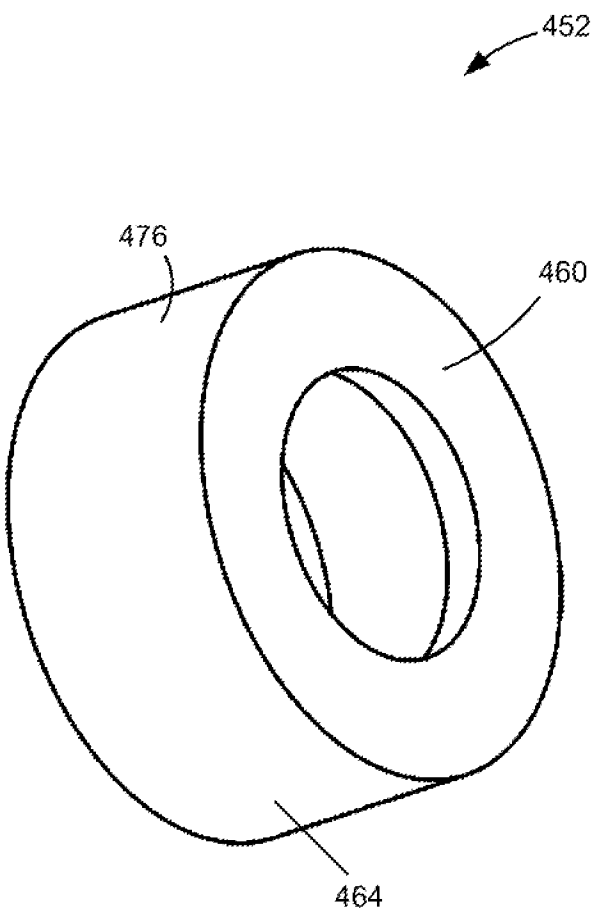
FIG. 54 is a front perspective view of a rotary lock in accordance with an embodiment.

Referring to FIGS. 53-55, rotary lock 452 can have any configuration suitable to releasably lock the rotary position of application brush 408 relative to brush handle 404. As shown, handle engagement portion 448 may include a socket 456 that receives at least a portion of brush engagement portion 444. It will be appreciated that this configuration may be reversed, whereby brush engagement portion 444 includes socket 456 that receives at least a portion of handle engagement portion 448. As shown, this socket connection allows brush engagement portion 444 to rotate relative to handle engagement portion 448 about rotation axis 440.

Rotary lock 452 may be mounted to one of engagement portions 444 and 448, and adjustably (e.g. releasably) connected to the other of engagement portions 444 and 448. In the illustrated example, rotary lock 452 is mounted to brush engagement portion 444 of brush handle 404 and releasably connected to handle engagement portion 448 of applicator brush 408. This allows rotary lock 452 to disconnect from applicator brush 408 so that applicator brush 408 can be disposed of and replaced with a new applicator brush 408. As shown, rotary lock 452 may include a collar 460 mounted to brush engagement portion 444, and a neck 464 extending from lock collar 460 that releasably engages handle engagement portion 448. Neck 464 may have internal threads 468 that engage external threads 472 provided on handle engagement portion 448. Threads 468 and 472 are only illustrated in FIG. 53 for clarity of illustration.

In use, a user may turn rotary lock 452 about rotation axis 440 to axially translate handle engagement portion 448 relative to brush engagement portion 444 along rotation axis 440 between an unlocked position and a locked position. In the locked position, rotary lock 452 pulls handle engagement portion 448 firmly against brush engagement portion 444, whereby frictional engagement between the engagement portions 444 and 448 inhibits them from rotating relative to each. In the unlocked position, rotary lock 452 moves handle engagement portion 448 axially away from brush engagement portion 444 whereby engagement portions 444 and 448 are free to rotate relative to each other. Rotary lock 452 may be further loosened to the point that lock threads 468 release from engagement portion threads 472, and applicator brush 408 can be disconnected from brush handle 404.

Figure 57:
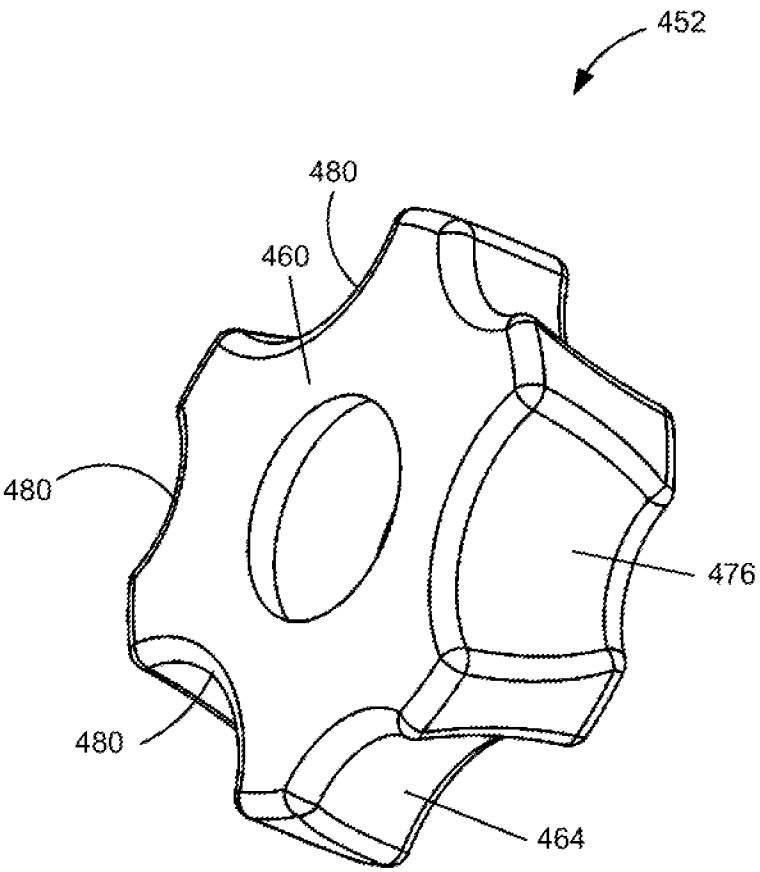
FIG. 57 is a front perspective view of the rotary lock of FIG. 56.
Figure 56:
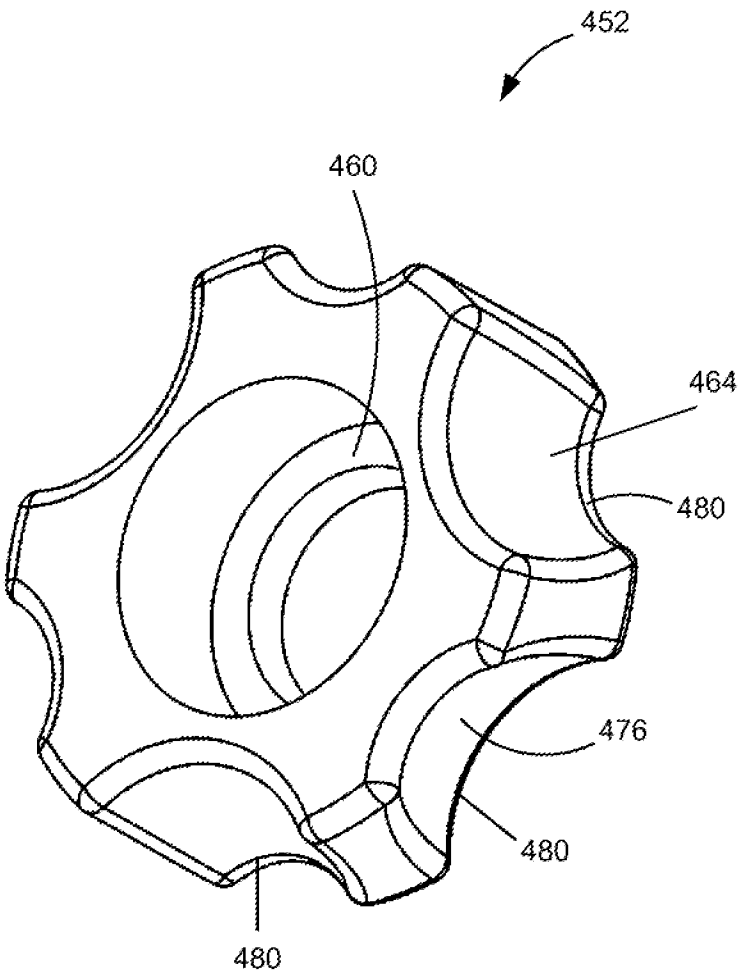
FIG. 56 is a rear perspective view of a rotary lock in accordance with another embodiment.

As shown in FIGS. 54-55, rotary lock 452 may have an outer handling surface 476 that a user can manually grasp (i.e. by hand) to turn rotary lock 452. FIGS. 56-57 show another embodiment of rotary lock 452 having an outer handling surface 476 formed with a plurality of concavities 480 sized to accommodate a user's fingers. Concavities 480 can provide the user with better grip, which make it easier to torque rotary lock 452 between the unlocked and locked positions.

Turning to FIG. 49, applicator brush 408 may include a plurality of angular indicators 484 that represent an angular orientation of applicator brush 408 relative to brush handle 404. Any indicators 484 suitable to represent the angular orientation may be used. In the illustrated example, indicators 484 are numbers 1 through 12. In other embodiments, indicators 484 may include a different range of numbers (e.g. 0 through 360), non-numeric symbols (e.g. letters, or shapes), a color progression (e.g. a plurality of colors in sequence), or combinations thereof. As shown, brush handle 404 may include a complimentary indicator 488 that identifies the brush indicator 484 associated with the current angular position of applicator brush 408 relative to brush handle 404.

Figure 24:
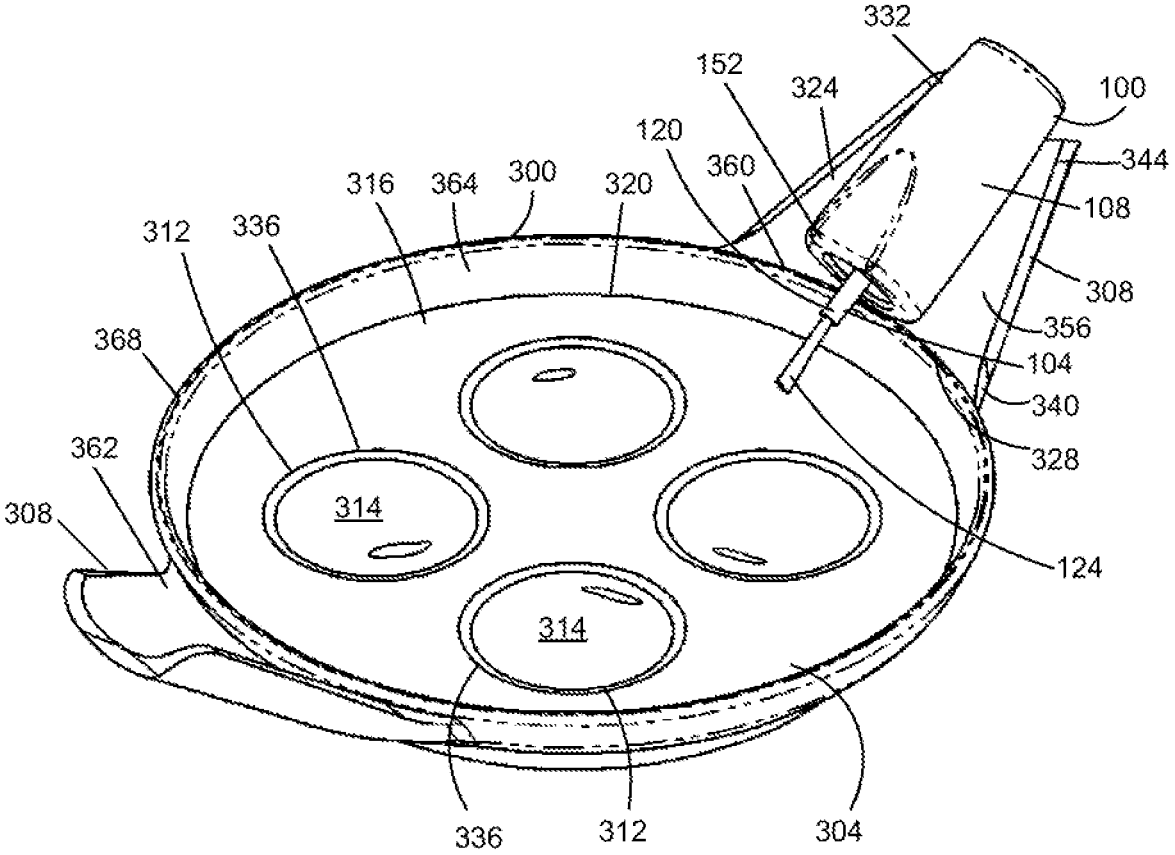
FIG. 24 is a perspective view of a nail polish cap and connected nail polish applicator brush supported on a nail polish pallet, in accordance with an embodiment.
Figure 25:
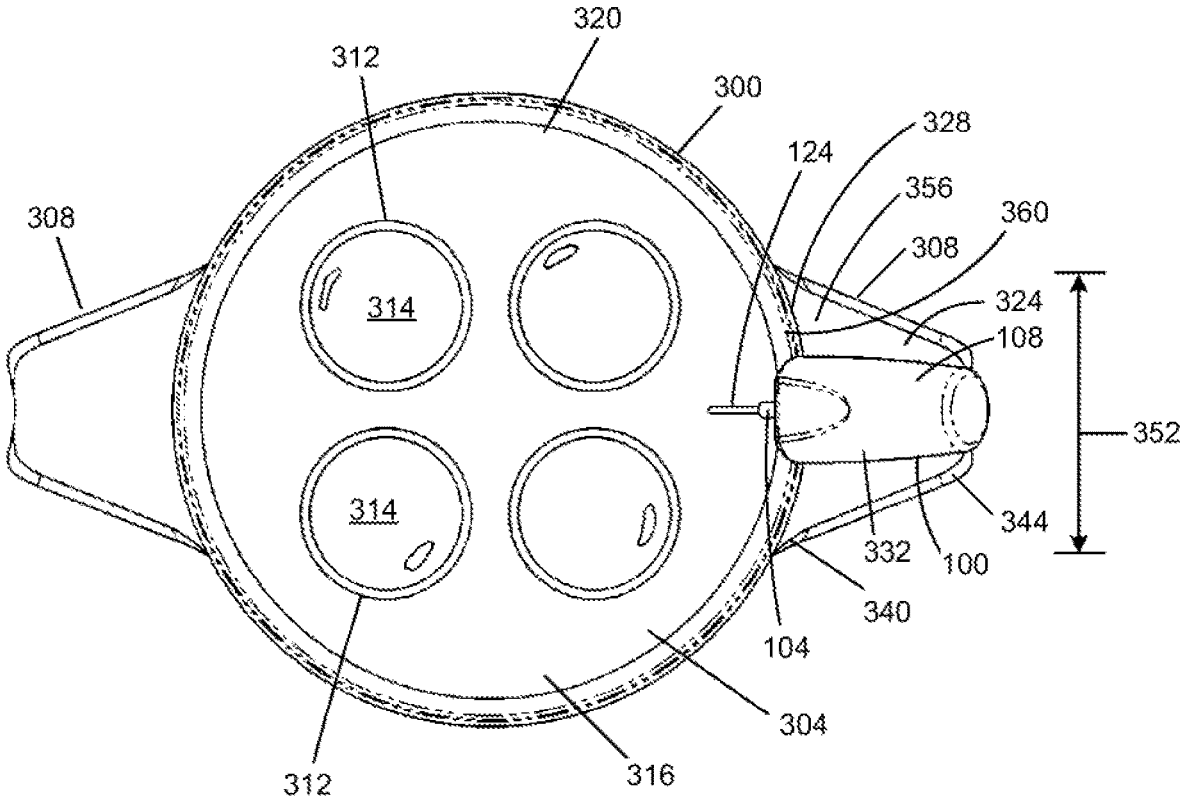
FIG. 25 is a top plan view of the nail cap and connected nail polish applicator brush supported on the nail polish pallet of FIG. 24.
Figure 26:
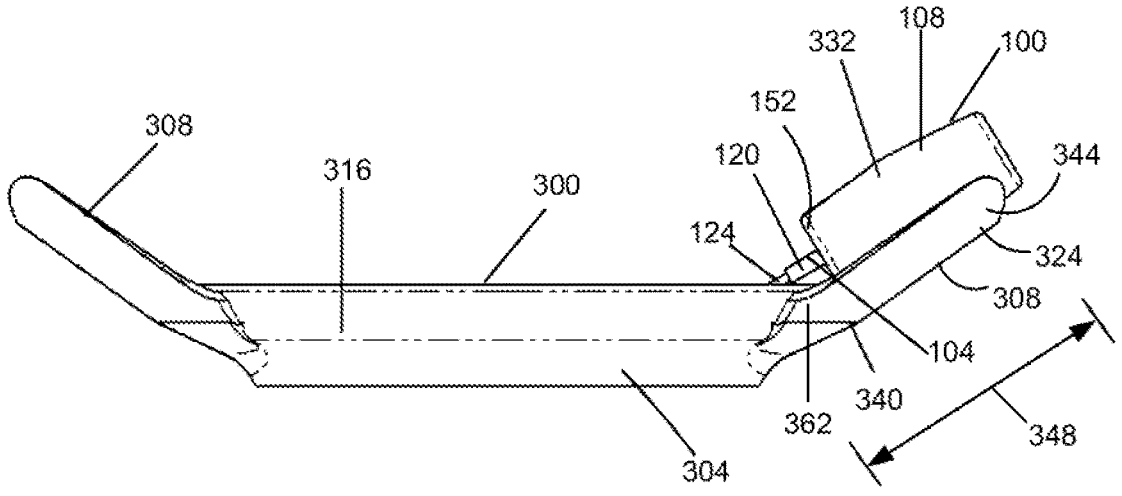
FIG. 26 is a side elevation view of the nail cap and connected nail polish applicator brush supported on the nail polish pallet of FIG. 24.

Reference is now made to FIGS. 24-26, which show a nail polish pallet 300 in accordance with an embodiment. Nail polish pallet 300 provides reservoirs to hold small volumes of several different nail polishes, and at least one nail polish cap stand to hold a nail polish cap 100 (with an attached nail polish applicator brush 104) in an upright orientation over the nail polish pallet 300. In many cases, two or more different nail polishes are applied to the nails of one person (e.g. beauty salon client, also referred to as a customer). Replacing a nail polish cap onto its nail polish bottle when switching between nail polishes can contaminate the nail polish bottle with fungal spores, bacteria, or dirt for example. The nail polish pallet 300 provides a sanitary solution, which supports the nail polish cap 100 and connected applicator brush 104 outside of the nail polish bottle.

The nail polish pallet 300 can catch nail polish that may drip from the nail polish applicator brush while supported on a cap rest. The upright orientation of the nail polish cap can prevent nail polish from running up the brush stem into the nail polish cap, which may occur if the nail polish brush is laid horizontally on its side or vertically upside down on the cap end face. Also, the upright orientation of the nail polish cap can provide a compact footprint, as compared with laying the nail polish applicator brush horizontally on its side. Embodiments of nail polish pallet 300 including a plurality of cap stands can allow several nail polish caps with applicator brushes to be used and supported concurrently, whether by adjacent users (e.g. beauty salon employees treating the same or different clients) or by the same user in applying several different nail polishes to one person.

Still referring to FIGS. 24-26, nail polish pallet 300 includes a base 304 and at least one nail polish cap stand 308. Nail polish base 304 includes a plurality of nail polish reservoirs 312 distributed over base upper surface 316 inboard of base periphery 320. Nail polish cap stand 308 is connected to nail polish base 304 and includes a cap rest 324 and a cap seat 328, which together provide a stable support for a nail polish cap 100 and connected applicator brush 104. Nail polish cap rest 324 provides support for an outer sidewall surface 332 (e.g. nail polish cap outer handling surface 108) of nail polish cap 100, and cap seat 328 provides support for cap lower end 152 of nail polish cap 100.

Nail polish reservoirs 312 can have any configuration suitable for holding a volume of nail polish 314. In the illustrated example, each nail polish reservoir 312 is formed as a depression (e.g. spherical, cylindrical, pyramidal, or cuboid depression) in base upper surface 316 and has an open reservoir upper end 336. Nail polish reservoirs 312 may be spaced apart so that the contained nail polishes 314 do not mix. Each nail polish reservoir 312 may be sized to hold a volume of nail polish 314 commensurate with a single use application to one person's nails. For example, nail polish reservoirs 312 may be sized to hold less than 5 mL (e.g. between 0.5 mL and 5 mL). In some embodiments, nail polish reservoirs 312 have a volume up to 10 mL (e.g. between 0.5 mL and 10 mL) with a view to filling the reservoir only partially and thus mitigating overflowing.

Nail polish cap stands 308 may be formed in any manner suitable for holding a nail polish cap 100 and connected nail polish applicator brush 104 over nail polish pallet base 304. In the illustrated example, nail polish cap stand 308 includes a cap rest 324 and a cap seat 328, which together support a nail polish cap 100 above pallet base 304. As shown, cap rest 324 extends longitudinally from a cap rest inner end 340 to a cap rest outer end 344, and has a longitudinal length 348 and transverse width 352.

Cap rest 324 may be inclined to horizontal to support nail polish cap 100 relatively upright, such that any nail polish on applicator brush 104 may drip onto nail polish pallet base 304 instead of flowing upwardly along brush stem 120 into nail polish cap 100. As shown, cap rest inner end 340 is connected to nail polish pallet base 304, and cap rest outer end 344 is positioned above and outboard of pallet base 304 and cap rest inner end 340. This may provide cap rest 324 with an inclined upper rest surface 356 for supporting nail polish cap outer sidewall surface 332.

Cap rest 324 may have any dimensions that can stably accommodate a nail polish cap 100. For example, cap rest 324 may have a transverse width 352 of between 1 cm and 5 cm, and a longitudinal length of between 2 cm and 10 cm. Cap rest upper rest surface 356 may be concave as shown, or planar for example. Nail polish cap 100 may have a substantially cylindrical shape which may provide little resistance to rolling in a transverse direction when rested. A concave shape (e.g. channel-like shape), such as shown, may provide additional transverse stability to a supported nail polish cap 100.

Cap seat 328 can have any configuration that can support nail polish cap 100 against sliding down cap rest upper rest surface 356 into nail polish pallet base 304. For example, cap rest 324 may provide a seating surface 360 for supporting cap lower end 152 when nail polish cap 100 is supported on cap stand 308. As shown, cap seat 328 may be positioned proximate to an inboard portion 362 of cap rest 324, and seating surface 360 may extend transversely to cap rest upper rest surface 356. In the illustrated example, cap seat 328 overlies and is spaced apart from cap rest inboard portion 362.

In some embodiments, cap rest 324 extends one or both of above and outboard of base upper surface 316, as shown. This can allow cap rest 324 to support cap lower end 152 at an angle and elevation that provides clearance for brush stem 120 (which extends past cap lower end 152) above pallet base 304. In some embodiments, cap rest 324 and cap seat 328 are positioned and oriented to support nail polish cap 100, with sufficient clearance above pallet base 304 that brush bristles 124 are overlaying and spaced apart from base upper surface 316. When brush bristles 124 containing nail polish are in contact with a surface, they tend to release the nail polish they contain. By holding the brush bristles 124 spaced apart from base upper surface 316, the loss of nail polish onto base upper surface 316 may be reduced.

Still referring to FIGS. 24-26, nail polish pallet 300 may include a rim 364 which at least partially surrounds nail polish base 304. Rim 364 extends upwardly from base 304 to a rim upper surface 368. In one aspect, rim 364 may help to inhibit nail polish on base upper surface 316 (e.g. drippings from applicator brush 104) from inadvertently spilling over base periphery 320 onto the surface (e.g. table) below. In some embodiments, rim 364 completely surrounds pallet base 304, as shown, so as to provide 360 degree protection against nail polish spilling over base periphery 320. For example, rim 364 may extend the entire length of base periphery 320.

In some embodiments, pallet rim 364 may form the cap seat 328 of each cap rest 324. For example, pallet rim 364 may overly cap rest inboard portion 362 as shown. As exemplified, pallet rim upper surface 368 may define each cap seat seating surface 360.

Nail polish cap rest 324 may be connected to nail polish base 304 in any manner suitable for carrying a nail polish cap 100 and applicator brush 104. In the illustrated example, nail polish rest 324 is integrally formed with nail polish base 304. Alternatively, nail polish cap rest 324 may be formed discretely and joined to nail polish base 304 (e.g. with adhesive, magnets, or fasteners).

Nail polish pallet 300 can be made of any material that is sufficiently impervious to nail polish 314 and sufficiently strong to carry a nail polish cap 100 and connected applicator brush 104. In some embodiments, nail polish pallet 300 is made of paper or plastic. For example, nail polish pallet 300 may be disposable and single-use. In other embodiments, nail polish pallet 300 is made of ceramic (e.g. porcelain), stone, or metal which may be easy to clean and sanitize for reuse.

Figure 27:
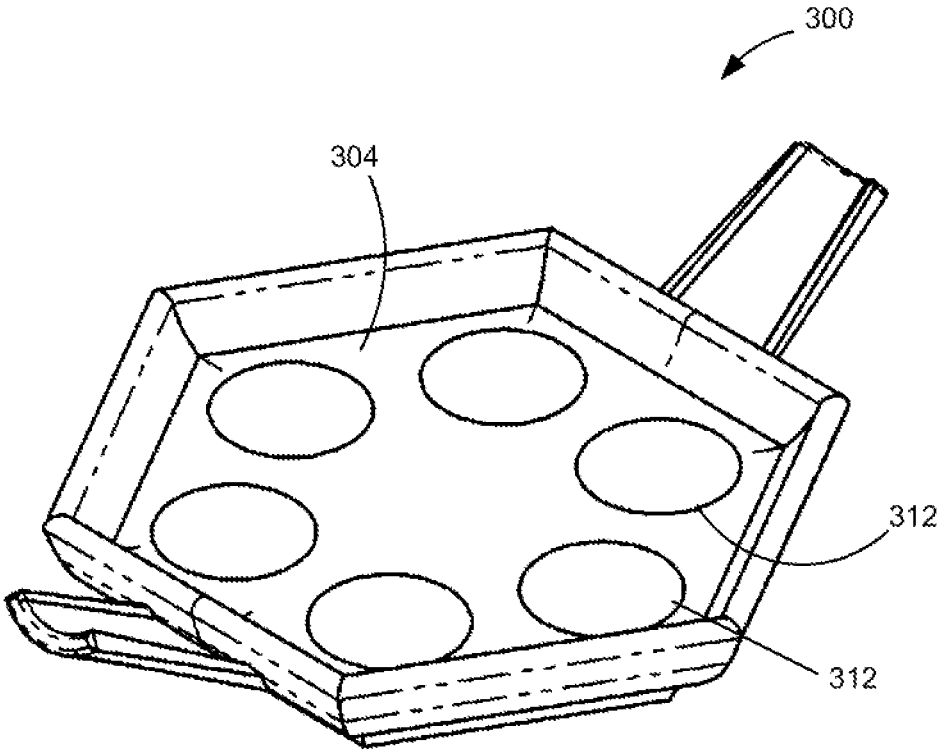
FIG. 27 is a perspective view of a nail polish pallet, in accordance with another embodiment.
Figure 28:
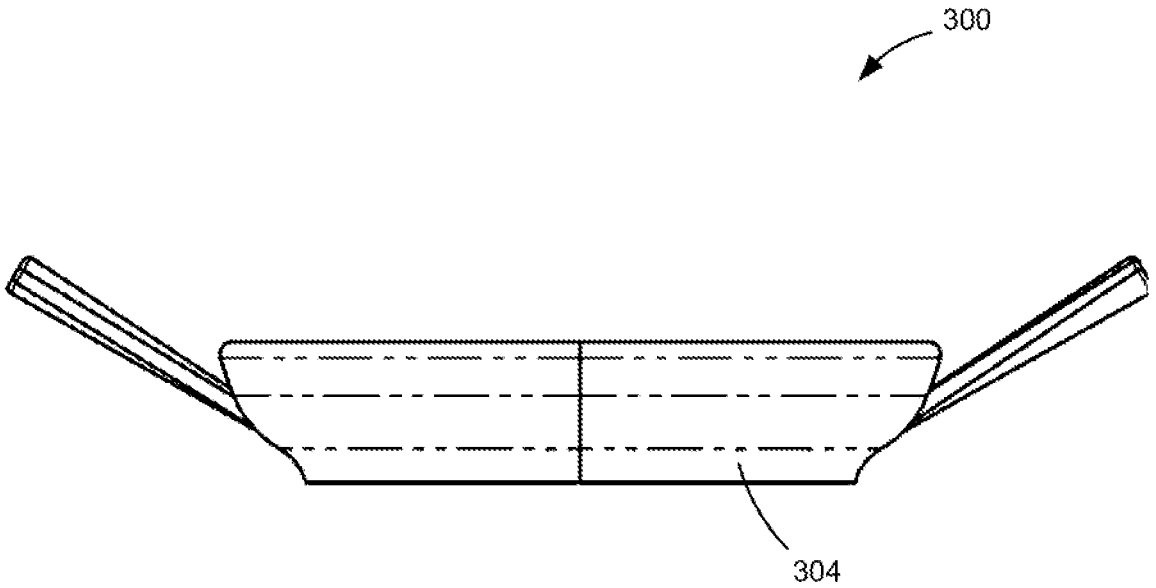
FIG. 28 is a side elevation view of the nail polish pallet of FIG. 27.
Figure 29:
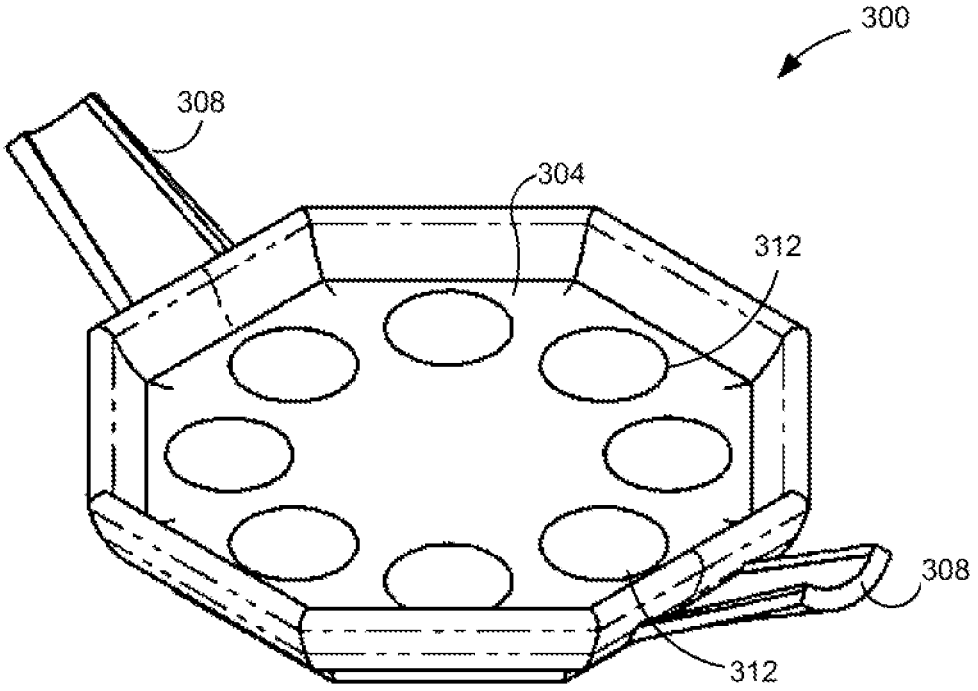
FIG. 29 is a perspective view of a nail polish pallet, in accordance with another embodiment.
Figure 30:
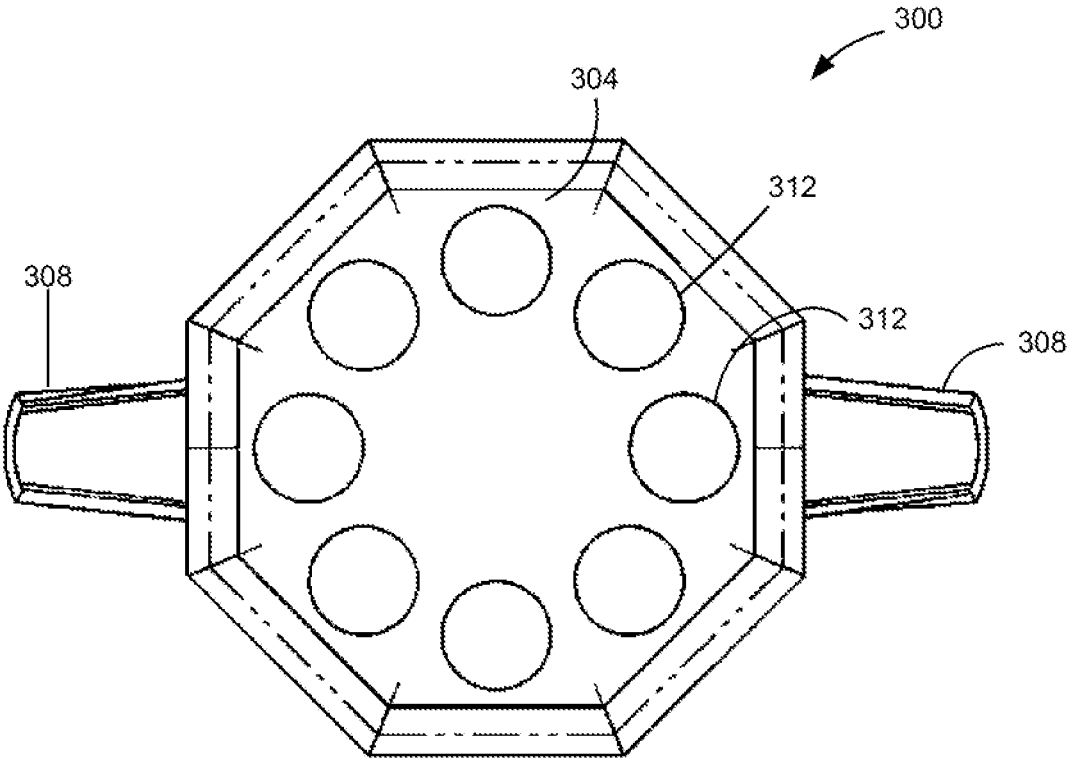
FIG. 30 is a side elevation view of the nail polish pallet of FIG. 29.
Figure 31:
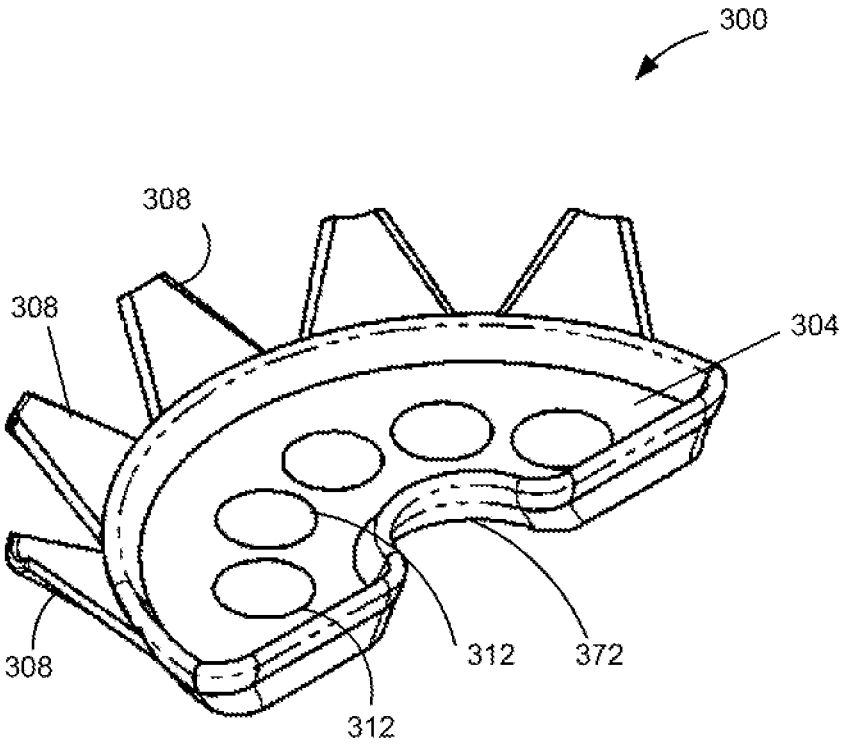
FIG. 31 is a perspective view of a nail polish pallet, in accordance with another embodiment.
Figure 32:
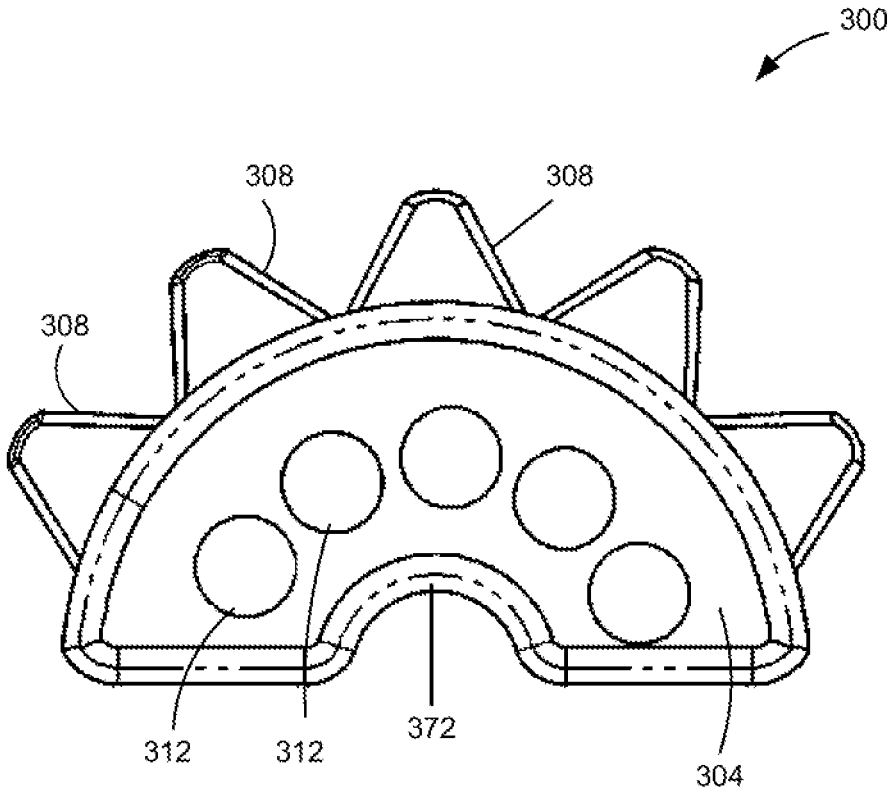
FIG. 32 is a top plan view of the nail polish pallet of FIG. 31.
Figure 33:
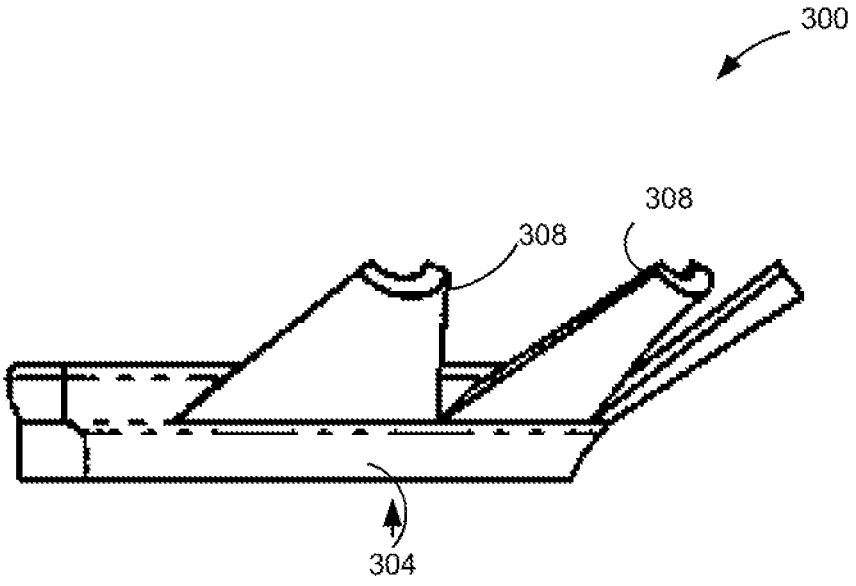
FIG. 33 is a side elevation view of the nail polish pallet of FIG. 31.

Nail polish base 304 can have any shape suitable for holding a plurality of nail polish reservoirs. For example, nail polish base 304 may be substantially circular as shown in FIGS. 24-26, hexagonal as shown in FIGS. 27-28, octagonal as shown in FIGS. 29-30, semi-circular or crescent shaped as shown in FIGS. 31-33, or another regular or irregular shape. The crescent-shaped nail polish pallet 300 of FIGS. 31-33 is shown including a thumb recess 372. Thumb recess 372 may be sized to accommodate a user's thumb when holding nail polish base 304, with the remainder of the user's fingers disposed below the nail polish base 304. This can provide a convenient manner of holding nail polish base 304, in which most of the user's hand is below the nail polish base 304 and thus clear of the nail polish reservoirs 312.

Figure 34:
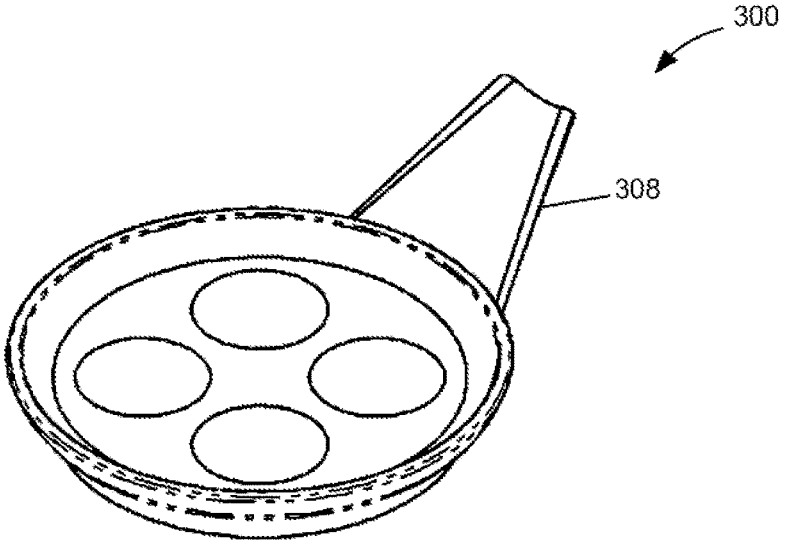
FIG. 34 is a perspective view of a nail polish pallet, in accordance with another embodiment.
Figure 35:
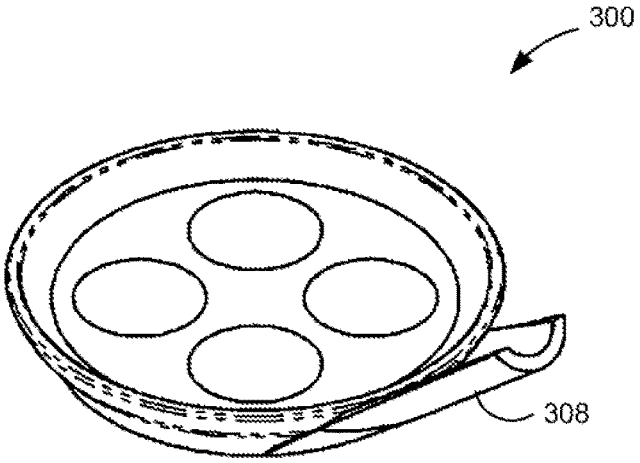
FIG. 35 is another perspective view of the nail polish pallet of FIG. 34.
Figure 36:
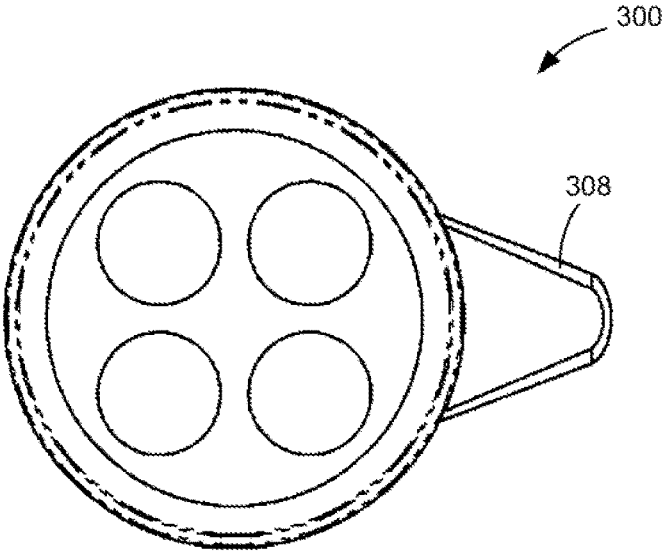
FIG. 36 is a top plan view of the nail polish pallet of FIG. 34.
Figure 37:
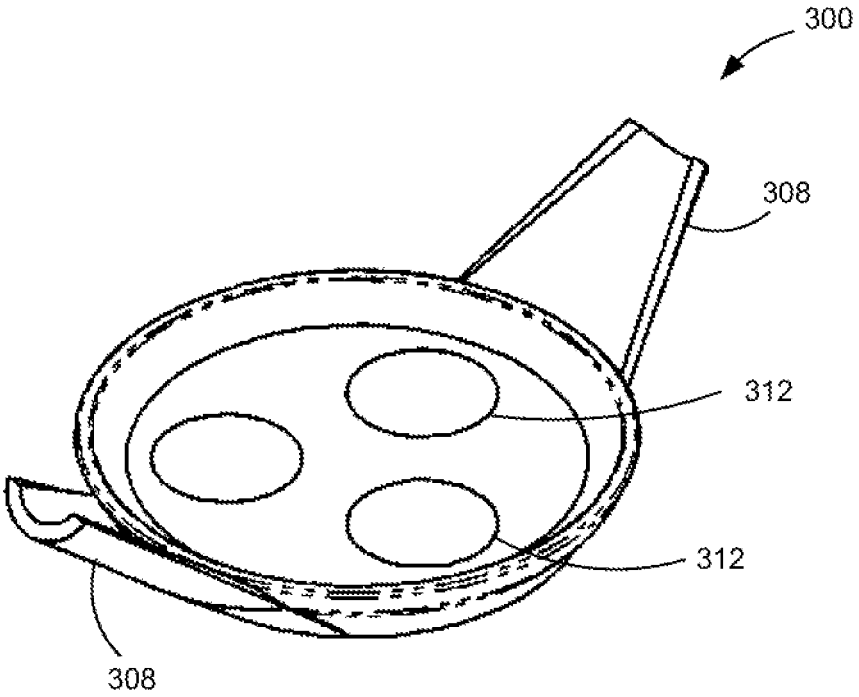
FIG. 37 is a perspective view of a nail polish pallet, in accordance with another embodiment.
Figure 38:
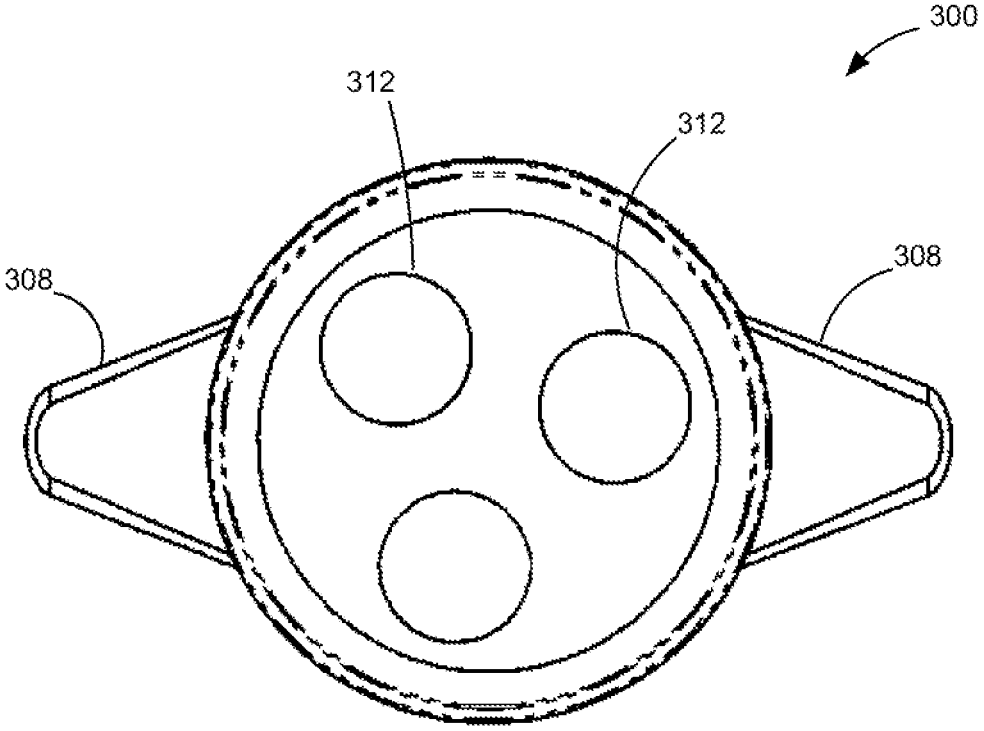
FIG. 38 is a top plan view of the nail polish pallet of FIG. 37.

Nail polish pallet 300 can include any number of cap stands 308. For example, nail polish pallet 300 can include one cap stand 308 as shown in FIGS. 34-36, two cap stands 308 as shown in FIGS. 37-38, three cap stands 308 as shown in FIGS. 39-40, four cap stands 308 as shown in FIGS. 41-42, five cap stands 308 as shown in FIGS. 31-33, or more than five cap stands 308.

Figure 39:
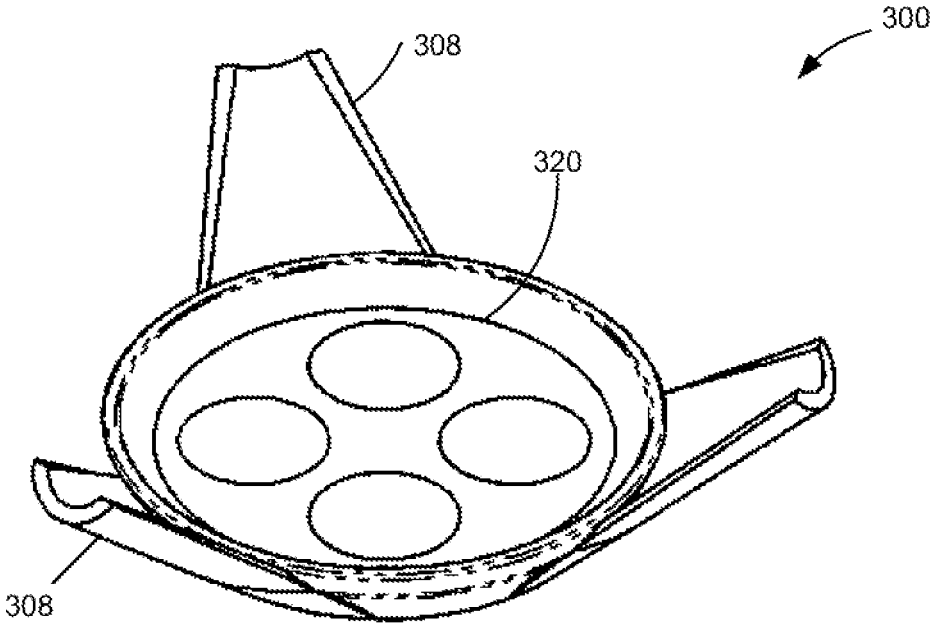
FIG. 39 is a perspective view of a nail polish pallet, in accordance with another embodiment.
Figure 40:
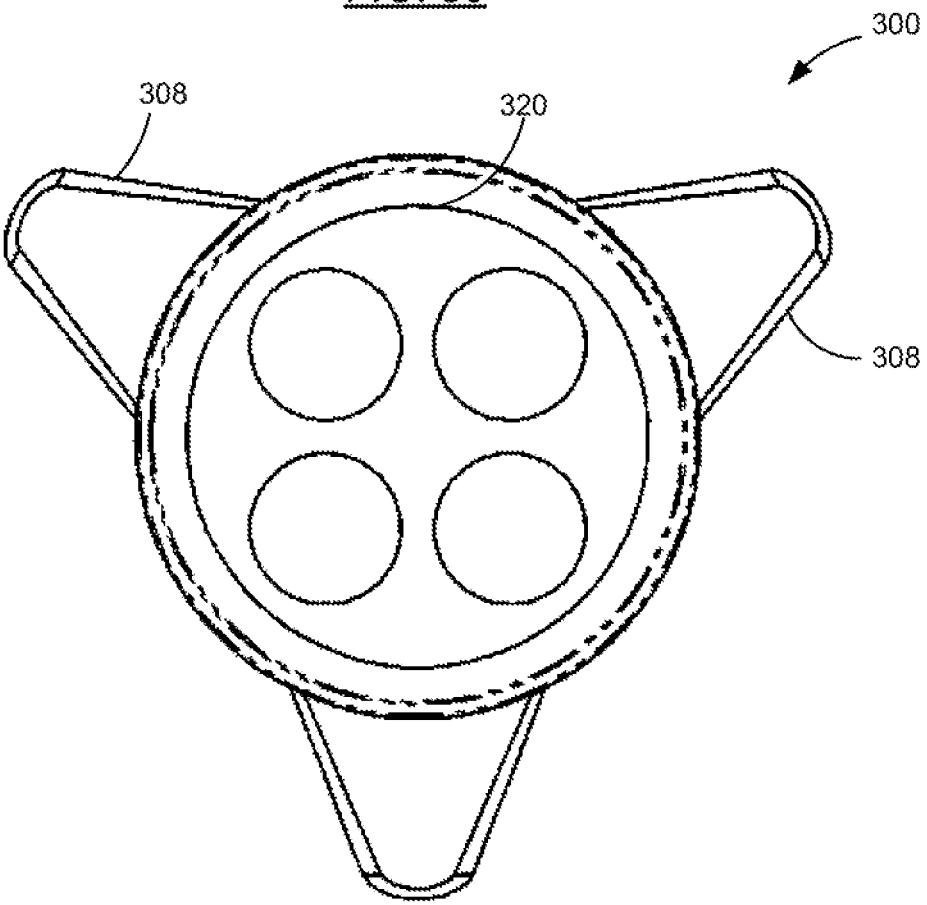
FIG. 40 is a top plan view of the nail polish pallet of FIG. 39.
Figure 41:
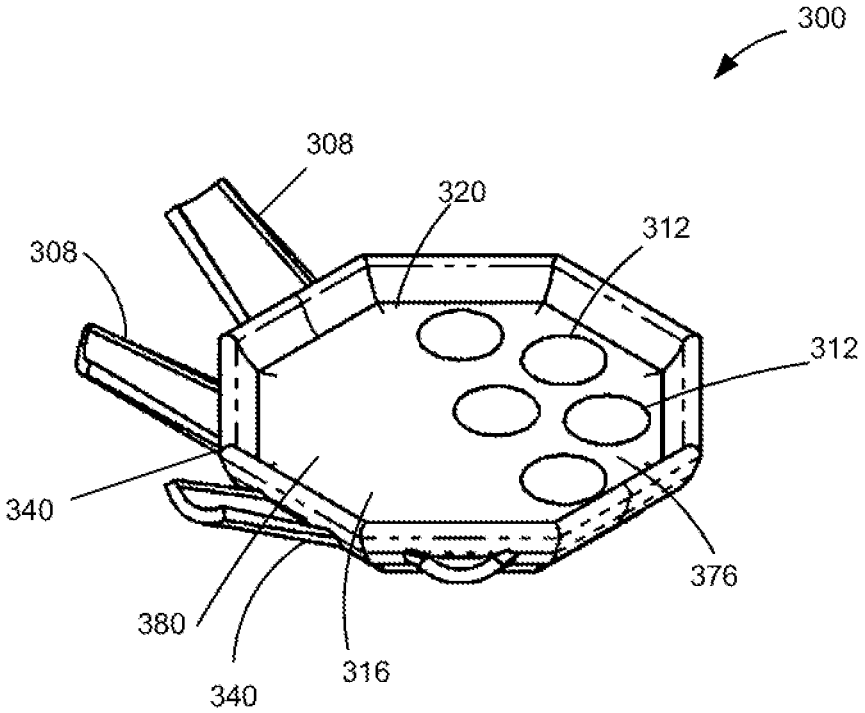
FIG. 41 is a perspective view of a nail polish pallet, in accordance with another embodiment.
Figure 42:
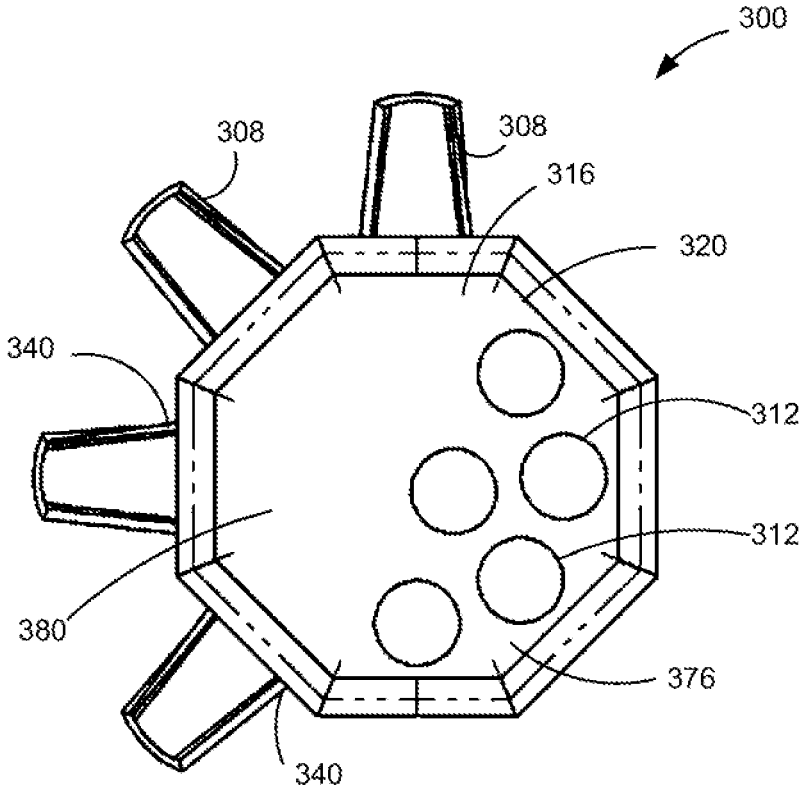
FIG. 42 is a top plan view of the nail polish pallet of FIG. 41.
Figure 43:
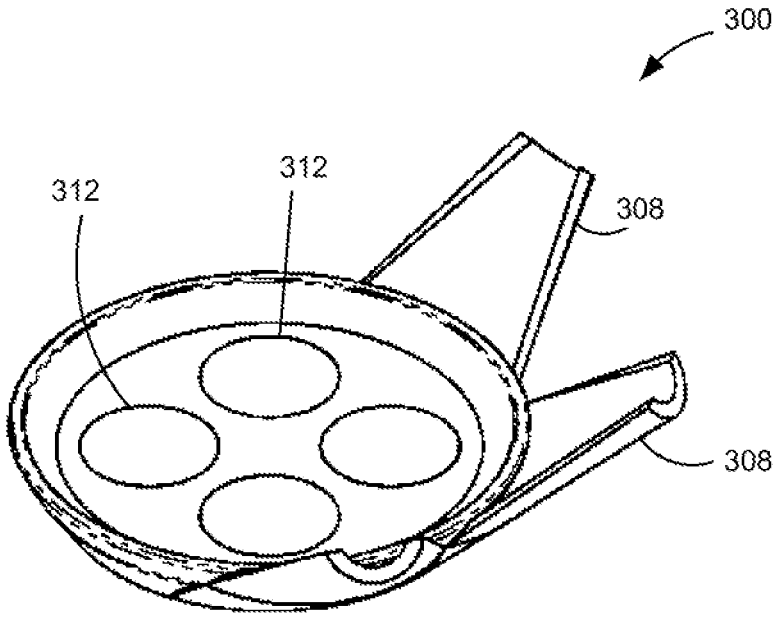
FIG. 43 is a perspective view of a nail polish pallet, in accordance with another embodiment.
Figure 44:
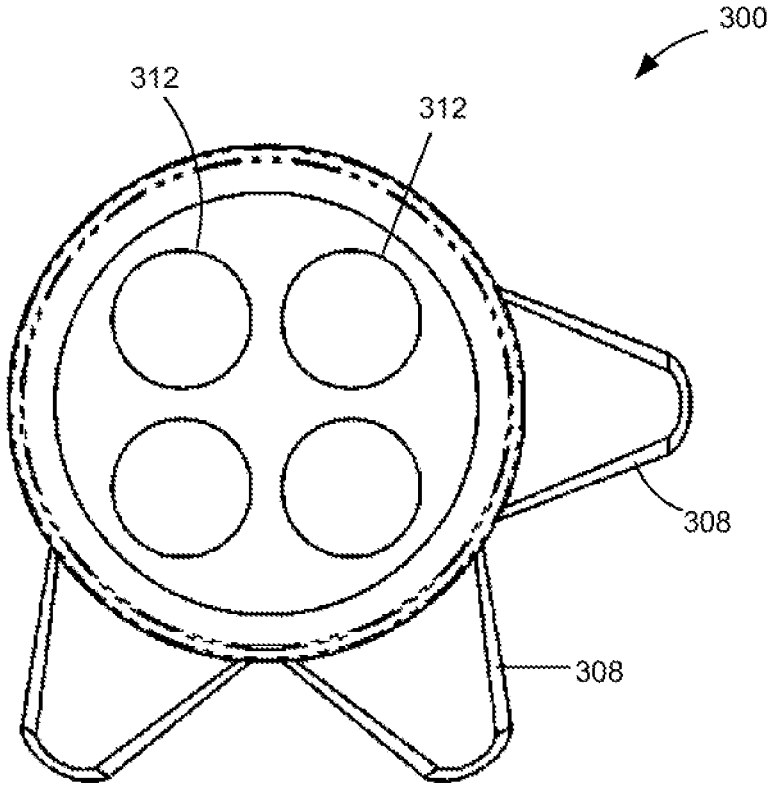
FIG. 44 is a top plan view of the nail polish pallet of FIG. 43.
Figure 45:
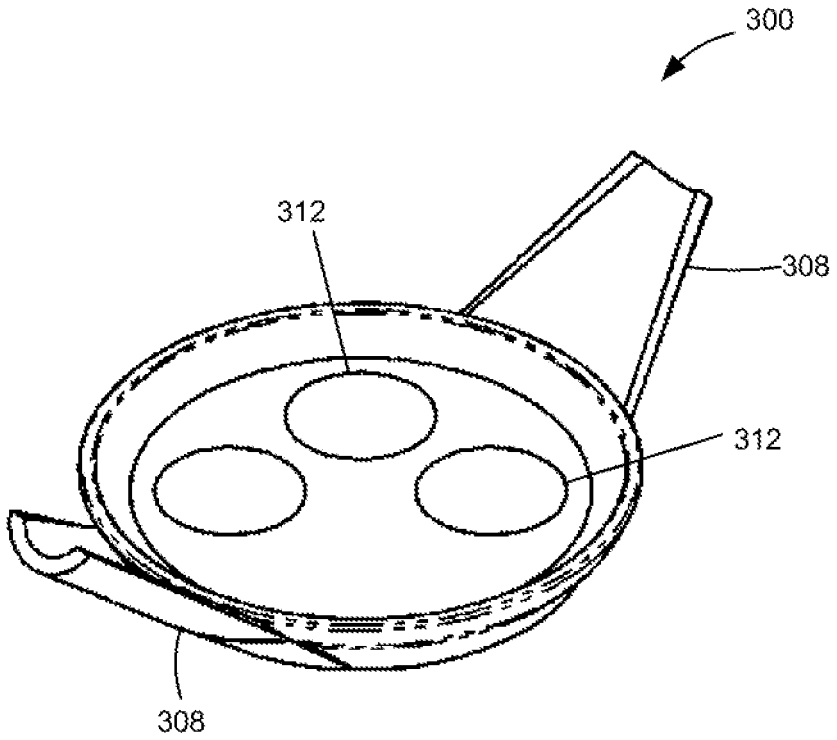
FIG. 45 is a perspective view of a nail polish pallet, in accordance with another embodiment.
Figure 46:
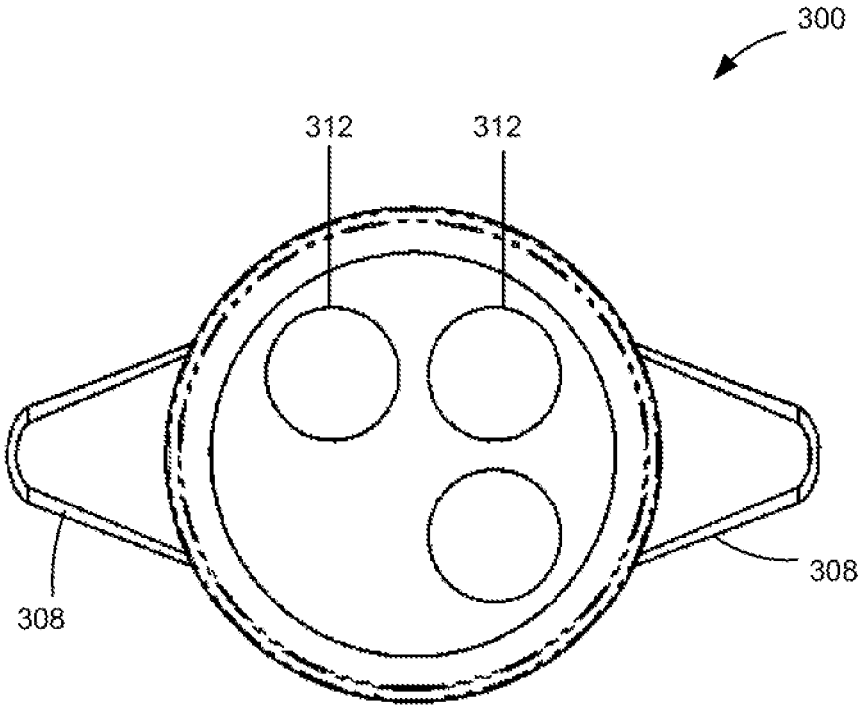
FIG. 46 is a top plan view of the nail polish pallet of FIG. 45.

Further, cap stands 308 may be evenly distributed (i.e. with even spacing) about the entire base periphery 320 as shown in FIGS. 39-40, or unevenly distributed about the base periphery 320 as shown in FIGS. 41-42. Similarly, nail polish reservoirs 312 can be evenly distributed over base upper surface 316 as shown in FIGS. 24-25, or unevenly distributed over base upper surface 316 as shown in FIGS. 41-42. In FIGS. 41-42, base upper surface 316 includes a first portion 376 having a distribution of nail polish reservoirs 312, and a second portion 380 that is free of nail polish reservoirs 312. As shown, cap stands 308 are arranged to support nail polish caps and connected applicator brushes over base upper surface second portion 380. For example, cap rest inner end 340 may be positioned proximate base upper surface second portion 380 as shown. This can allow any nail polish that drips from the applicator brushes to catch on base upper surface 316 away from nail polish reservoirs 312, thereby mitigating unintentional mixing of different nail polishes. First and second portions 376 and 380 of base upper surface 316 can have any relative size ratio. In the illustrated embodiment, first and second portions 376 and 380 are substantially equal in size. In other embodiments, one of first and second portions 376 and 380 may be larger than the other (e.g. a ratio of 2:1, 3:1, or higher).

Nail polish pallet 300 can have any number of nail polish reservoirs 312 that includes at least two nail polish reservoirs 312. For example, nail polish pallet 300 may include three nail polish reservoirs 312 as shown in FIGS. 37-38, four nail polish reservoirs 312 as shown in FIGS. 24-26, five nail polish reservoirs 312 as shown in FIG. 31-32, six nail polish reservoirs 312 as shown in FIG. 27, eight nail polish reservoirs 312 as shown in FIGS. 29-30, or another number (e.g. 2-20) of nail polish reservoirs 312.

Nail polish pallet 300 may have greater nail polish reservoirs 312 than cap stands 308 as shown in FIGS. 24-25, the same number of nail polish reservoirs 312 as cap stands 308 as shown in FIGS. 31-32, or greater cap stands 308 than nail polish reservoir 312.

Referring to FIGS. 43-46, in some embodiments, nail polish pallet 300 includes one fewer cap stands 308 than the number of nail polish reservoirs 312. This can allow the user to hold one nail polish cap 100 (and connected brush 104) (FIG. 24) associated with the nail polish of one reservoir 312 in hand, and rest the remaining nail polish caps 100 (and connected brushes 104) associated with each of the other nail polishes in the other reservoirs 312 on cap stands 308. A nail polish pallet 300 having the same number of cap stands 308 as nail polish reservoirs 312 (see, e.g. FIG. 31) can allow the nail polish cap 100 (and associated brush 104) associated with every nail polish reservoir 312 to be rested on a cap stand 308. This may allow the user (e.g. beauty salon employee) to take a pause from painting nails to perform another task (e.g. cash out a customer or answer the phone).

Figure 47:
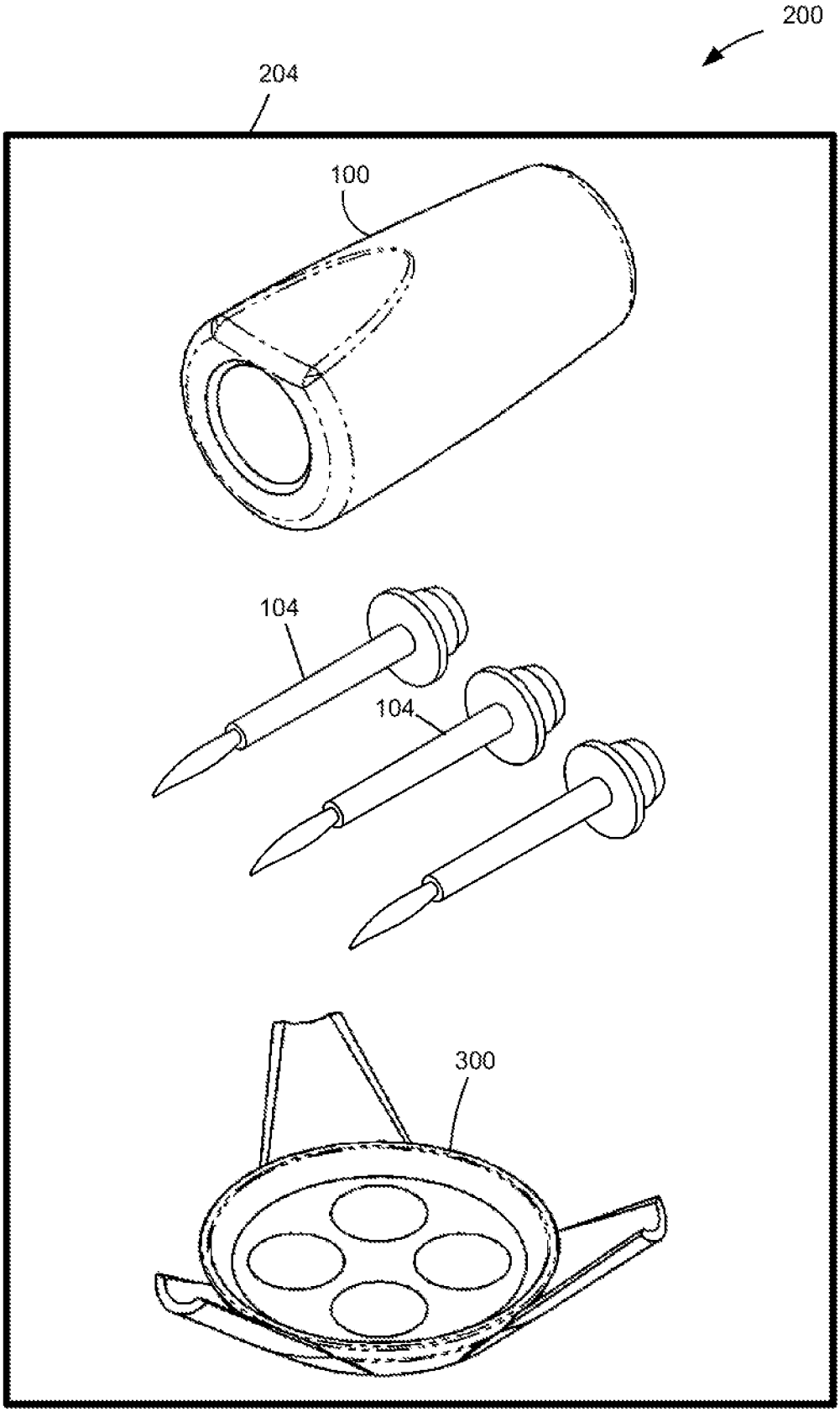
FIG. 47 is a schematic view of a nail polish system in accordance with another embodiment.

Reference is now made to FIG. 47, which shows another embodiment of nail polish system 200. As shown, nail polish system 200 may include one or more nail polish caps 100, a plurality of nail polish applicator brushes 104 (greater in number than caps 100), and one or more nail polish pallets 300. Nail polish pallet 300 has cap stands 308 which are particularly sized to accommodate nail polish cap 100 and a connected nail polish applicator brush 104.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items

Item 1: A nail polish pallet comprising:

a base having a plurality of nail polish reservoirs inboard of a base periphery, each reservoir formed as a depression in the base with an open reservoir upper end; and at least one nail polish cap stand coupled to the base, each nail polish cap stand including a cap rest and a cap seat,

- the cap rest having an upper rest surface with a longitudinal length and transverse width, the upper rest surface extending longitudinally from a cap rest inner end to a cap rest outer end, the cap rest outer end positioned above and outboard of the base and the cap rest inner end,
- the cap seat positioned proximate an inboard portion of the cap rest, and having a seating surface extending transversely to the upper rest surface.

Item 2: The nail polish pallet of any preceding item, wherein the seating surface extends above the base.

Item 3: The nail polish pallet of any preceding item, wherein the seating surface extends outboard of the base.

Item 4: The nail polish pallet of any preceding item, wherein the cap seat overlies the inboard portion of the cap rest.

Item 5: The nail polish pallet of any preceding item, further comprising:

a rim at least partially surrounding the base, and extending upwardly from the base periphery to an rim upper surface above the base.

Item 6: The nail polish pallet of any preceding item, wherein:

the rim forms the cap seat of each of the at least one nail polish cap stand.

Item 7: The nail polish pallet of any preceding item, wherein:

the rim upper surface forms the seating surface of each of the at least one nail polish cap.

Item 8: The nail polish pallet of any preceding item, wherein:

the rim completely surrounds the base.

Item 9: The nail polish pallet of any preceding item, wherein:

the at least one nail polish cap stand includes a plurality of nail polish cap stands equal in number to the nail polish reservoirs.

Item 10: The nail polish pallet of any preceding item, wherein:

the nail polish reservoirs are distributed about a first portion of the base, and each nail polish cap stand extends from proximate a second portion of the base, the second portion of the base being free of nail polish reservoirs.

Item 11: The nail polish pallet of any preceding item, wherein:

each nail polish reservoir has a volume capacity of less than 5 mL.

Item 12: A nail polish system comprising:

a nail polish cap having an outer handling surface, an inner bottle engagement portion, and an inner applicator brush engagement portion; and a plurality of nail polish applicator brushes, each nail polish applicator brush including

- a stem extending longitudinally from a stem inboard end to a stem outboard end,
- a plurality of bristles extending longitudinally from a bristle inboard end, connected to the stem outboard end, and a bristle outboard end, and
- a cap engagement portion connected to the stem inboard end, the cap engagement end being removably connectable to the inner applicator brush engagement portion of the nail polish cap.

Item 13: The nail polish system of any preceding item, wherein:

the nail polish cap has a cap upper end opposite a cap lower end, the cap lower end having an opening to the inner bottle engagement portion and the inner applicator brush engagement portion.

Item 14: The nail polish system of any preceding item, wherein:

the inner applicator brush engagement portion is positioned upwardly of the inner bottle engagement portion.

Item 15: The nail polish system of any preceding item, wherein the cap engagement portion is sized to provide a press-fit when mated with the inner applicator brush engagement portion.

Item 16: The nail polish system of any preceding item, wherein the cap engagement portion and the inner applicator brush engagement portion include mating threads.

Item 17: The nail polish system of any preceding item, further comprising:

the nail polish pallet of any preceding item, wherein the cap rest and cap seat are sized and positioned to support the nail polish cap having a nail polish applicator brush of the plurality of nail polish applicator brushes connected thereto.

Item 18: The nail polish system of any preceding item, wherein:

the nail polish cap has a cap upper end opposite a cap lower end, the nail polish applicator brush extends downwardly from the cap lower end when connected to the nail polish cap, and the nail polish cap is positionable on the cap rest with the cap lower end supported on the cap seat.

Item 19: The nail polish system of any preceding item, wherein:

the cap rest and cap seat are positioned and oriented to support the nail polish cap with bristles of the nail polish applicator brush overlaying and spaced apart from the base, when the nail polish applicator brush is connected to the nail polish cap.

Item 20: The nail polish system of any preceding item, wherein the plurality of nail polish applicator brushes includes at least 50 identical disposable nail polish applicator brushes.

Item 21: A method of sanitary practice for a beauty salon comprising:

applying nail polish to at least one nail of a first person, using a first nail polish applicator brush removably connected to a nail polish cap;

after said applying, removing the nail polish applicator brush from the nail polish cap, and disposing of the first nail polish applicator brush;

connecting a second nail polish applicator brush, structurally identical to the first nail polish applicator brush, to the nail polish cap; and applying nail polish to at least one nail of a second person, using the second nail polish applicator brush removably connected to the nail polish cap.

Item 22: A nail polish system comprising:

a brush handle having an outer handling surface, a handle longitudinal axis, and a brush engagement portion;

at least one nail polish applicator brush, each nail polish applicator brush including:

a base extending longitudinally from a base inboard end to a base outboard end, a plurality of bristles extending longitudinally from a bristle inboard end to a bristle outboard end, the bristle inboard end connected to the base outboard end, and a handle engagement portion connected to the base inboard end, the handle engagement portion being removably and rotatably connectable to the nail polish applicator brush engagement portion, and when connected the nail polish applicator brush is rotatable relative to the brush handle about a rotation axis transverse to the handle longitudinal axis.

Item 23: The nail polish system of any preceding item, wherein:

the nail polish applicator brush includes a plurality of angular indicators representative of a an angular orientation of the nail polish applicator brush relative to the brush handle about the rotation axis.

Item 24: The nail polish system of any preceding item, further comprising:

a lock engagable with the brush handle and the nail polish applicator brush, the lock having a locked position in which an angular orientation of the nail polish applicator brush relative to the brush handle is fixed, and an unlocked position in which an angular orientation of the nail polish applicator brush relative to the brush handle is adjustable.

Item 25: The nail polish system of any preceding item, wherein:

the at least one nail polish applicator brush comprises a plurality of nail polish applicator brushes.

The invention claimed is:

1. A nail polish system comprising:

a brush handle having an outer handling surface, a handle longitudinal axis, and a brush engagement portion;

at least one nail polish applicator brush, each nail polish applicator brush including:

a base extending longitudinally from a base inboard end to a base outboard end, a plurality of bristles extending longitudinally from a bristle inboard end to a bristle outboard end, the bristle inboard end connected to the base outboard end, and a handle engagement portion connected to the base inboard end, the handle engagement portion being removably and rotatably connectable to the nail polish applicator brush engagement portion, and when connected the nail polish applicator brush is rotatable relative to the brush handle about a rotation axis transverse to the handle longitudinal axis, wherein the nail polish applicator brush includes a plurality of angular indicators representative of an angular orientation of the nail polish applicator brush relative to the brush handle about the rotation axis.

2. The nail polish system of claim 1, further comprising:

a lock engagable with the brush handle and the nail polish applicator brush, the lock having a locked position in which an angular orientation of the nail polish applicator brush relative to the brush handle is fixed, and an unlocked position in which an angular orientation of the nail polish applicator brush relative to the brush handle is adjustable.

3. The nail polish system of claim 1, wherein:

the at least one nail polish applicator brush comprises a plurality of nail polish applicator brushes.

* * * * *